US012084093B2

(12) United States Patent
Otsuka

(10) Patent No.: US 12,084,093 B2
(45) Date of Patent: Sep. 10, 2024

(54) ARTICLE TRANSPORT FACILITY

(71) Applicant: Daifuku Co., Ltd., Osaka (JP)

(72) Inventor: Hiroshi Otsuka, Hinocho (JP)

(73) Assignee: Daifuku Co., Ltd., Osaka (JP)

( * ) Notice: Subject to any disclaimer, the term of this patent is extended or adjusted under 35 U.S.C. 154(b) by 678 days.

(21) Appl. No.: 17/395,538

(22) Filed: Aug. 6, 2021

(65) Prior Publication Data

US 2022/0041189 A1 Feb. 10, 2022

(30) Foreign Application Priority Data

Aug. 7, 2020 (JP) ..... 2020-135010

(51) Int. Cl.
*B61C 17/12* (2006.01)
*B61C 11/04* (2006.01)
*B61C 13/00* (2006.01)

(52) U.S. Cl.
CPC ..... *B61C 17/12* (2013.01); *B61C 11/04* (2013.01); *B61C 13/00* (2013.01)

(58) Field of Classification Search
CPC ..... B61C 17/12; B61C 11/04; B61C 13/00
See application file for complete search history.

(56) References Cited

U.S. PATENT DOCUMENTS 9,758,308 B1 * 9/2017 Nishikawa ..... H01L 21/67715
10,940,878 B2 * 3/2021 Murakami ..... B61B 3/02
2008/0055103 A1 * 3/2008 Koide ..... B66F 9/072 340/686.6
2011/0106341 A1 * 5/2011 Kinoshita ..... G05D 1/0289 701/2
2014/0236426 A1 * 8/2014 Kosaka ..... B62K 11/007 701/41
2015/0187218 A1 * 7/2015 Harasaki ..... G05D 1/0289 701/2
2023/0192412 A1 * 6/2023 Otsuka ..... H01L 21/6735 198/465.1

FOREIGN PATENT DOCUMENTS

JP 2010282569 A 12/2010

* cited by examiner

*Primary Examiner* — Scott A Browne
(74) *Attorney, Agent, or Firm* — The Webb Law Firm

(57) ABSTRACT

A travel unit travels in a curved section in an orientation in which a target wheel comes into contact with a target rail, a guide wheel comes into contact with a guide rail, and a non-target wheel does not come into contact with a non-target rail. The control unit changes the rotational speed of a first wheel and a second wheel in the curved section relative to the rotational speed of the first wheel and the second wheel in a straight section in accordance with the ratio of a second length, which is the length of the target rail along a travel path, to a first length, which is the length of the curved section along the travel path at a center portion in a widthwise direction of the travel path.

7 Claims, 7 Drawing Sheets

ARTICLE TRANSPORT FACILITY

CROSS-REFERENCE TO RELATED APPLICATION

This application claims priority to Japanese Patent Application No. 2020-135010 filed Aug. 7, 2020, the disclosure of which is hereby incorporated by reference in its entirety.

BACKGROUND OF THE INVENTION

1. Field of the Invention

The present invention relates to an article transport facility that includes a travel rail arranged along a travel path, a transport vehicle that travels along the travel rail and transports an article, and a control unit that controls a traveling operation of a travel unit of the transport vehicle.

2. Description of the Related Art

An example of an article transport facility such as the above-described one is disclosed in JP 2010-282569A (Patent Document 1). In the following, reference numerals in parentheses in the description of background art are those used in Patent Document 1. The article transport facility described in Patent Document 1 includes a travel rail (4), a transport vehicle (3) that travels along the travel rail (4), and a travel control unit (59) that controls a traveling operation of the transport vehicle (3). The transport vehicle (3) includes a first drive wheel (25) that is driven by a first motor (26), and a second drive wheel (28) that is driven by a second motor (29). As described in paragraphs 0052 to 0054 in Patent Document 1, when the transport vehicle (3) travels in a curved portion (8), the center speed of the transport vehicle (3) can be adjusted to a prescribed speed by decelerating an inner wheel, out of the first drive wheel (25) and the second drive wheel (28), and accelerating an outer wheel.

SUMMARY OF THE INVENTION

There are cases where the two left and right wheels (the first drive wheel and the second drive wheel in Patent Document 1) of a transport vehicle are driven to rotate at the same speed, unlike the transport vehicle in Patent Document 1. In this case as well, the transport vehicle is required to appropriately travel in a curved section of a travel path that is formed in a curved shape in a plan view. However, Patent Document 1 does not include a description of this point.

There is demand for realization of an article transport facility in which a transport vehicle can appropriately travel in a curved section when the two left and right wheels of the transport vehicle are driven to rotate at the same speed.

An article transport facility according to the present disclosure includes: travel rails arranged along a travel path; a transport vehicle configured to travel along the travel rails and transport an article; and a control unit configured to control a traveling operation of a travel unit included in the transport vehicle, wherein the travel path includes a straight section that is formed in a straight shape in a plan view, and a curved section that is formed in a curved shape in a plan view, in the straight section, a first travel rail and a second travel rail among the travel rails are arranged separately on respective sides of a center portion in a widthwise direction of the travel path, and in the curved section, assuming that one out of the first travel rail and the second travel rail is a target rail and the other one is a non-target rail, at least the target rail, out of the target rail and the non-target rail, is arranged, and a guide rail that is different from the target rail and the non-target rail is also arranged along the travel path, the travel unit includes a first wheel configured to roll on a traveling surface of the first travel rail, a second wheel configured to roll on a traveling surface of the second travel rail, a drive unit configured to rotate the first wheel and the second wheel at the same speed, and a guide wheel configured to roll on a guide surface of the guide rail, assuming that a target wheel is the first wheel when the target rail is the first travel rail, the target wheel is the second wheel when the target rail is the second travel rail, and a non-target wheel is whichever one of the first wheel and the second wheel is not the target wheel, the travel unit travels in the curved section in an orientation in which the target wheel comes into contact with the target rail, the guide wheel comes into contact with the guide rail, and the non-target wheel does not come into contact with the non-target rail, and the control unit changes a rotational speed of the first wheel and the second wheel in the curved section relative to a rotational speed of the first wheel and the second wheel in the straight section in accordance with a ratio of a second length, which is a length of the target rail along the travel path, to a first length, which is a length of the curved section along the travel path at the center portion in the widthwise direction of the travel path.

According to the present configuration, the orientation of the travel unit when traveling in the curved section is an orientation in which the target wheel comes into contact with the target rail, the guide wheel comes into contact with the guide rail, and the non-target wheel does not come into contact with the non-target rail. As a result, the transport vehicle can appropriately travel with the target wheel and the non-target wheel rotated at the same speed in the curved section in which the length of the movement trajectory of the target wheel differs from the length of the movement trajectory of the non-target wheel. That is to say, according to the present configuration, the transport vehicle can appropriately travel in the curved section when the two left and right wheels of the transport vehicle are driven to rotate at the same speed.

Further, in the present configuration, the rotational speed of the first wheel and the second wheel in the curved section is changed relative to the rotational speed of the first wheel and the second wheel in the straight section in accordance with the ratio of the second length to the first length. Here, the ratio of the second length to the first length is the same as or similar to the ratio of the moving speed of the target wheel to the moving speed of a center portion (a center portion in the widthwise direction; the same follows below) of the transport vehicle. For this reason, the moving speed of the center portion of the transport vehicle in the curved section can be brought closer to the moving speed of the center portion of the transport vehicle in the straight section by setting the rotational speed of the first wheel and the second wheel in the curved section as described above. As a result, it is possible to reduce a speed change at the center portion of the transport vehicle when passing through a boundary between the straight section and the curved section, and to reduce the vibration that may occur on the transport vehicle and the article transported by the transport vehicle.

Note that, in the case where, unlike the present configuration, the rotational speed of the first wheel and the second wheel in the curved section is not changed relative to the rotational speed of the first wheel and the second wheel in the straight section, the moving speed of the center portion of the transport vehicle in the curved section in which the target rail is located on the inner-circumferential side becomes higher than the moving speed of the center portion of the transport vehicle in the straight section. For this reason, it may be necessary to reduce the moving speed of the center portion of the transport vehicle in the straight section in order to reduce the moving speed of the center portion of the transport vehicle in the curved section to the maximum allowable speed or less. In contrast, according to the present configuration, the moving speed of the center portion of the transport vehicle in the curved section can be brought closer to the moving speed of the center portion of the transport vehicle in the straight section. Therefore, it is less necessary to reduce the moving speed of the center portion of the transport vehicle in the straight section, and the time required for the transport vehicle to travel along the travel path that includes both the straight section and the curved section can also be shortened.

Further features and advantages of the article transport facility will become apparent from the following description of the embodiments, which will be described with reference to the drawings.

DETAILED DESCRIPTION OF PREFERRED EMBODIMENTS

Figure 1:
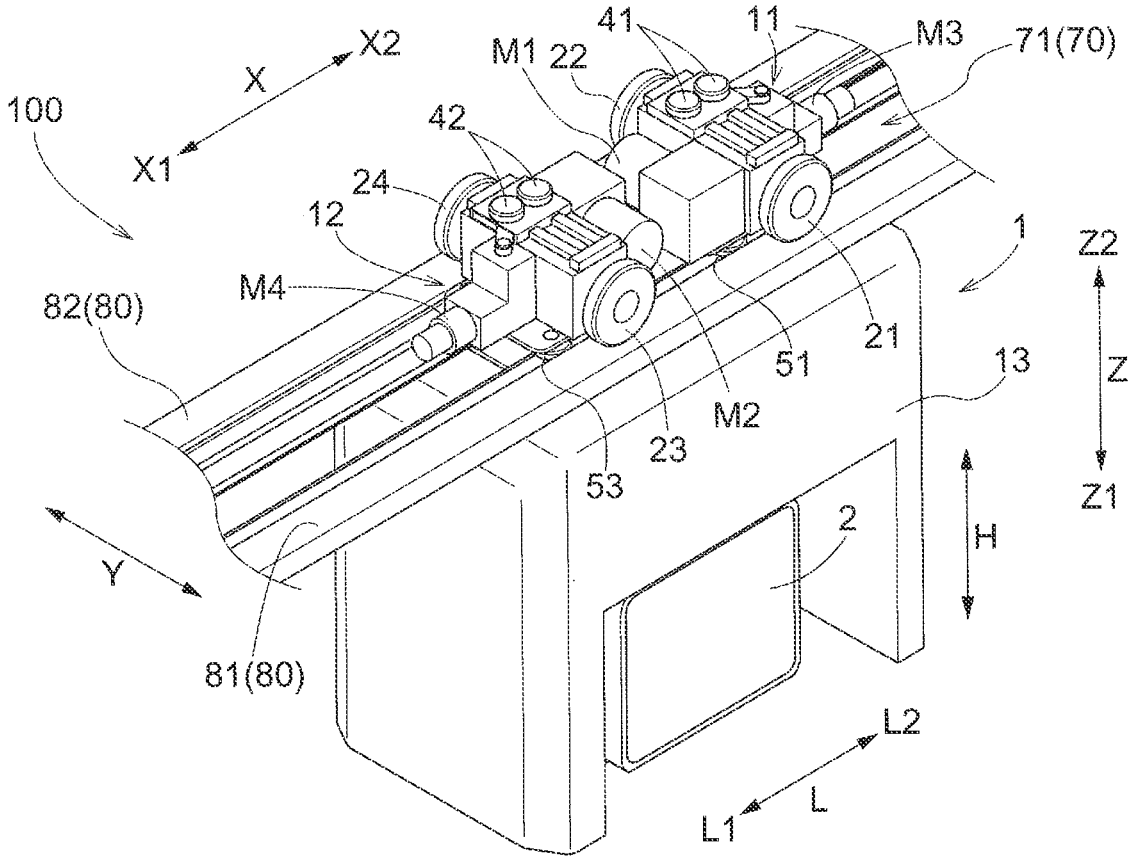
FIG. 1 is a perspective view of a transport vehicle.
Figure 4:
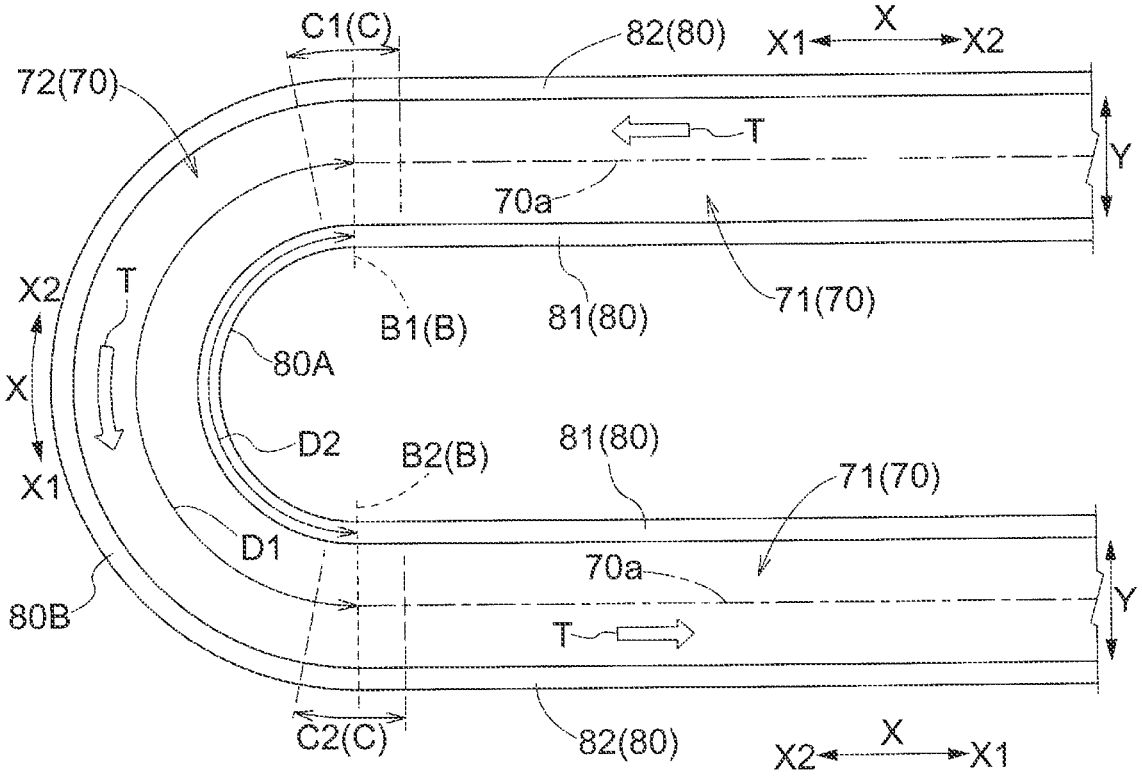
FIG. 4 is a plan view of a portion of a travel path.

An embodiment of an article transport facility will be described with reference to the drawings. As shown in FIG. 1, an article transport facility 100 includes travel rails 80 arranged along a travel path 70, and a transport vehicle 1 that travels along the travel rails 80 and transports an article 2. Here, the lengthwise direction of the travel path 70 (the direction of in which the travel path 70 extends) is referred to as a path-length direction X, and the widthwise direction of the travel path 70 is referred to as a path-width direction Y, as shown in FIG. 1. The path-width direction Y is a direction orthogonal to both the path-length direction X and the vertical direction Z. As shown in FIG. 4, in the present embodiment, a traveling direction T of the transport vehicle 1 in the travel path 70 is set in one direction, the forward side in the traveling direction of the transport vehicle 1 in the path-length direction X is referred to as a downstream side X1, and a backward side in the traveling direction of the transport vehicle 1 in the path-length direction X is referred to as an upstream side X2. In the present embodiment, the path-width direction Y corresponds to a "widthwise direction".

In the present embodiment, the transport vehicle 1 is a ceiling transport vehicle that travels along the travel path 70 formed along a ceiling. For this reason, although not shown in the diagrams, the travel rails 80 and a later-described guide rail 83 (see FIG. 2) are supported while being suspended from the ceiling, for example. Note that the transport vehicle 1 may be a transport vehicle other than a ceiling transport vehicle. Further, the article 2 is, for example, an FOUP (Front Opening Unified Pod) for containing a semiconductor wafer, but the type of article 2 is not limited thereto.

As shown in FIG. 4, the travel path 70 includes straight sections 71 that are formed in a straight shape in a plan view (a view in a direction parallel to the vertical direction Z), and a curved section 72 that is formed in a curved shape in a plan view. Two travel rails 80, namely a first travel rail 81 and a second travel rail 82 are arranged in each straight section 71. The first travel rail 81 and the second travel rail 82 are arranged separately on respective sides of a center portion 70*a* in the path-width direction Y of the travel path 70. In each straight section 71, the center position in the path-width direction Y between the first travel rail 81 and the second travel rail 82 is the center portion 70*a* in the path-width direction Y of the travel path 70. In the following, the side closer to the center portion 70*a* in the path-width direction Y is referred to as an inner side of the path-width direction Y, and the side farther from the center portion 70*a* in the path-width direction Y is referred to as an outer side of the path-width direction Y.

Assuming that one out of the first travel rail 81 and the second travel rail 82 is a target rail 80A, and the other one is a non-target rail 80B, at least the target rail 80A, out of the target rail 80A and the non-target rail 80B, is arranged in the curved section 72. Assuming that the gap in the path-width direction Y between the first travel rail 81 and the second travel rail 82 in each straight section 71 is a travel path width, the target rail 80A is arranged at a position at which the gap between the target rail 80A and the center portion 70*a* in the path-width direction Y of the travel path 70 is half the travel path width. If, as in the example shown in FIG. 4, the target rail 80A is whichever one (the first travel rail 81 in FIG. 4) of the first travel rail 81 and the second travel rail 82 is arranged on the inner side (the side closer to the turning center) in the curved section 72, the position spaced apart, on the outer side (the side farther from the turning center), from the target rail 80A by a distance corresponding to half the travel path width corresponds to the center portion 70*a* in the path-width direction Y of the travel path 70. On the other hand, if the target rail 80A is whichever one of the first travel rail 81 and the second travel rail 82 is arranged on the outer side of the curved section 72, the position spaced apart, on the inner side, from the target rail 80A by the distance corresponding to half the travel path width corresponds to the center portion 70*a* in the path-width direction Y of the travel path 70.

In the example shown in FIG. 4, in addition to the target rail 80A, the non-target rail 80B (the second travel rail 82 in FIG. 4) is also arranged in the curved section 72. The non-target rail 80B is arranged at a position at which the gap between the non-target rail 80B and the center portion 70*a* in the path-width direction Y of the travel path 70 is half the travel path width. If both the target rail 80A and the non-target rail 80B are arranged in the curved section 72, the center position in the path-width direction Y between the target rail 80A and the non-target rail 80B corresponds to the center portion 70*a* in the path-width direction Y of the travel path 70. Note that although the curved section 72 shown in FIG. 4 connects end portions of two straight sections 71, the curved section 72 may alternatively branch from a straight section 71 or merge with a straight section 71.

Figure 2:
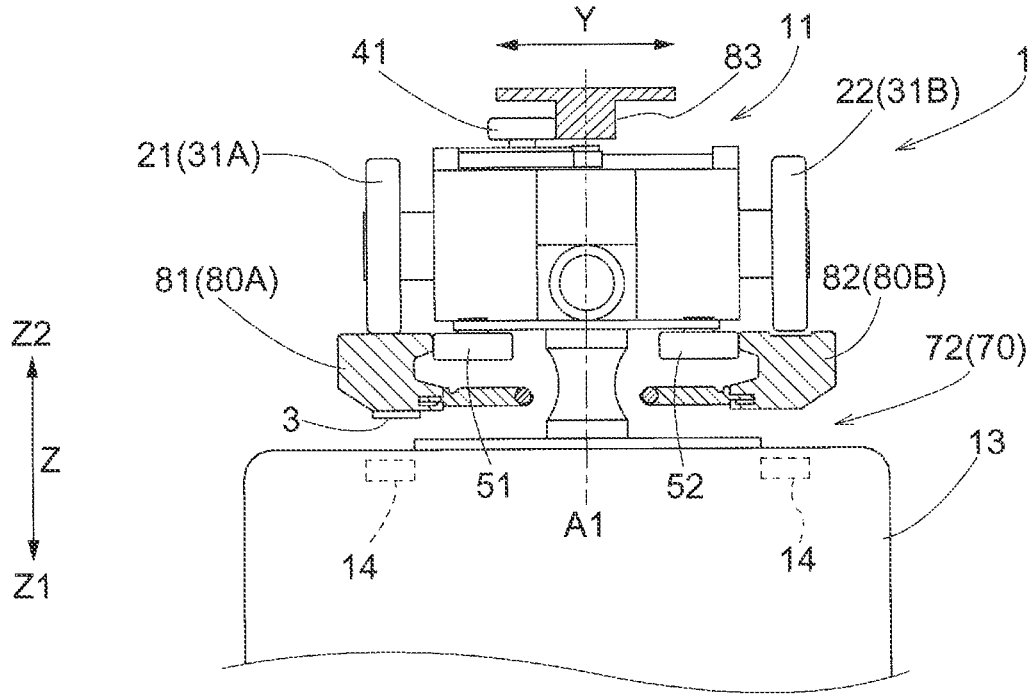
FIG. 2 is a front view of a travel unit.
Figure 5:
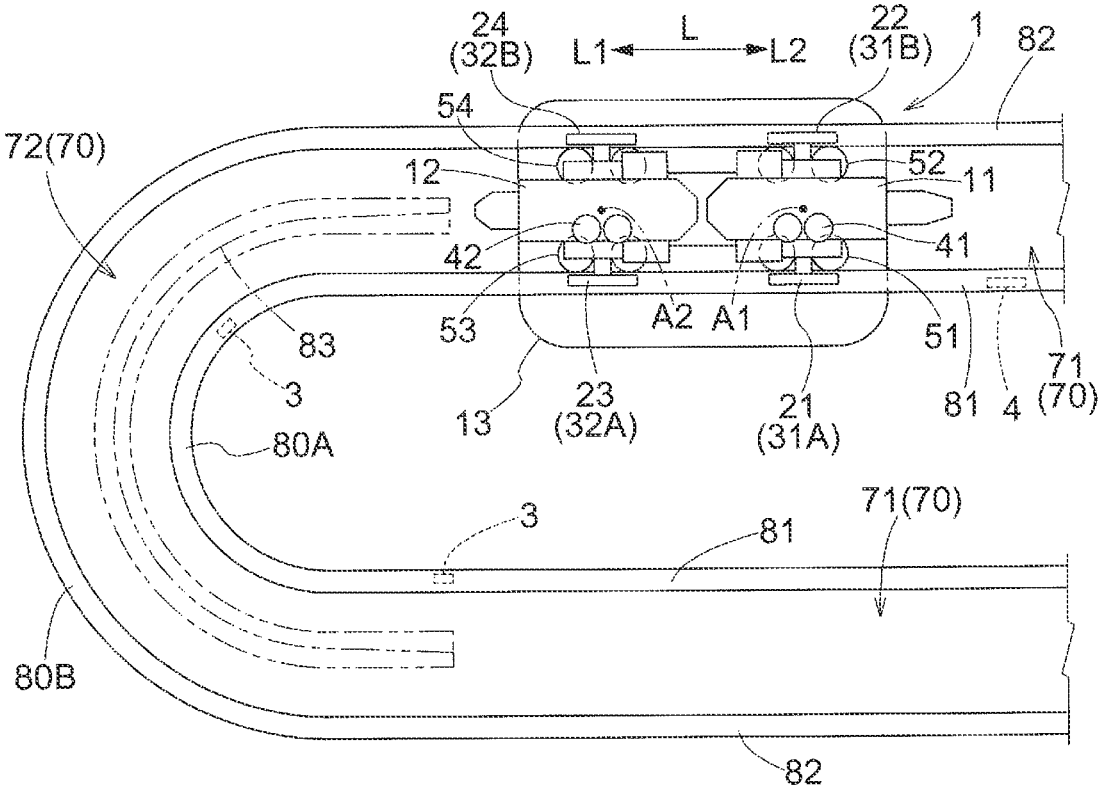
FIG. 5 is a plan view of the transport vehicle located in a straight section.
Figure 6:
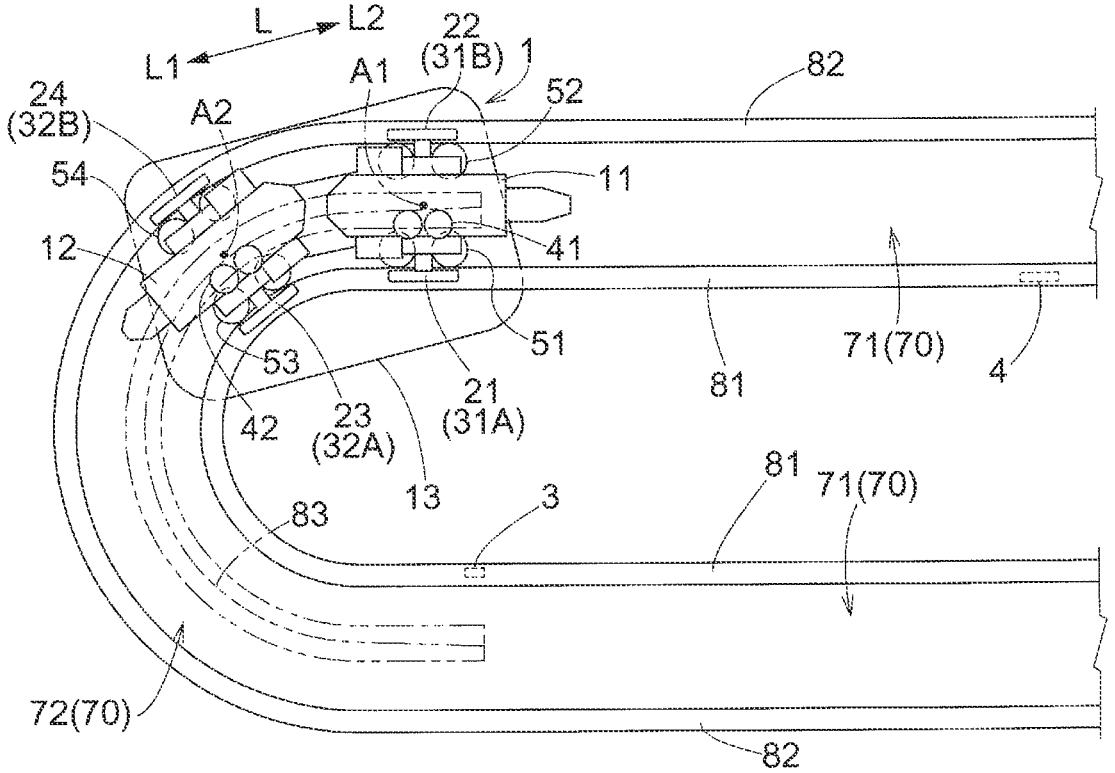
FIG. 6 is a plan view of the transport vehicle located at a boundary between the straight section and a curved section.

Although omitted in FIG. 4, a guide rail 83, which is different from the target rail 80A and the non-target rail 80B, is arranged along the travel path 70 in the curved section 72, as shown in FIGS. 2, 5, and 6. Here, the guide rail 83 is arranged at the center portion 70*a* in the path-width direction Y of the travel path 70. As shown in FIGS. 1, 5, and 6, the guide rail 83 is not arranged in the straight sections 71.

As shown in FIG. 1, the transport vehicle 1 includes a first travel unit 11. In the present embodiment, the travel unit 1 further includes a second travel unit 12. The second travel unit 12 is arranged on a front side L1 in a vehicle front-back direction L of the first travel unit 11. In other words, the first travel unit 11 is arranged on a back side L2 in the vehicle front-back direction L of the second travel unit 12. The vehicle front-back direction L is a direction defined based on the transport vehicle 1 serving as a reference (i.e., a direction that changes in accordance with the direction of the transport vehicle 1 as shown in FIGS. 5 and 6), and the transport vehicle 1 is arranged in the travel path 70 in an orientation in which the vehicle front-back direction L is parallel to the path-length direction X. That is to say, the vehicle front-back direction L is a direction parallel to the travel path 70. In the curved section 72, the transport vehicle 1 is arranged in the travel path 70 in an orientation in which the vehicle front-back direction L is parallel to a direction that is tangential to the path-length direction X, which forms a curved shape, in a plan view. A direction that is defined based on the transport vehicle 1 serving as a reference and parallel to the vertical direction Z when the transport vehicle 1 is in a state of being arranged in a straight section 71 is referred to as a vehicle vertical direction H. A direction in which a first axis A1 and a second axis A2, which will be described later, are connected when viewed in the vehicle vertical direction H (see FIG. 5) is the vehicle front-back direction L. In the present embodiment, the first travel unit 11 corresponds to a "travel unit", the vehicle front-back direction L corresponds to a "front-back direction", and the vehicle vertical direction H corresponds to a "vertical direction".

The transport vehicle 1 includes a main body portion 13, which is connected to the first travel unit 11. In the present embodiment, the main body portion 13 is supported by the first travel unit 11 in a state where the main body portion 13 is arranged on a lower side Z1 in the vertical direction Z of the first travel unit 11. In the present embodiment, the main body portion 13 is also connected to the second travel unit 12, and the main body portion 13 is supported by the first travel unit 11 and the second travel unit 12 in a state where the main body portion 13 is arranged on the lower side Z1 of the first travel unit 11 and the second travel unit 12. That is to say, the transport vehicle 1 includes the main body portion 13 that is connected to the first travel unit 11 and the second travel unit 12. Although details are omitted, the main body portion 13 includes a support portion for supporting an article 2, and the article 2 is transported by the transport vehicle 1 while being supported by the main body portion 13.

As shown in FIG. 1, the first travel unit 11 includes a first wheel 21 that rolls on a traveling surface of the first travel rail 81, a second wheel 22 that rolls on a traveling surface of the second travel rail 82, a first drive unit M1 (e.g., an electric motor such as a servo motor) that rotates the first wheel 21 and the second wheel 22 at the same speed, and first guide wheels 41 that roll on a guide surface of the guide rail 83. The traveling surface of the first travel rail 81 and the traveling surface of the second travel rail 82 are surfaces (horizontal surfaces in the example in FIG. 2) that face toward the upper side Z2 in the vertical direction Z, and the guide surface of the guide rail 83 is a surface (a vertical surface in the example in FIG. 2) that faces toward one side in the path-width direction Y. In the present embodiment, one first wheel 21 and one second wheel 22 are provided, and two first guide wheels 41 are arranged in a line in the vehicle front-back direction L. The first wheel 21 and the second wheel 22 rotate about an axis orthogonal to the vehicle vertical direction H, and the first guide wheels 41 rotate (idle in this example) about respective axes parallel to the vehicle vertical direction H. The first wheel 21 and the second wheel 22 are formed to have the same diameter. The first travel unit 11 travels along the travel rail 80 as a result of the first wheel 21 and the second wheel 22 being driven to rotate by the first drive unit M1. In the present embodiment, the first drive unit M1 corresponds to a "drive unit", and the first guide wheel 41 corresponds to a "guide wheel".

As shown in FIG. 1, the second travel unit 12 includes a third wheel 23 that rolls on a traveling surface of the first travel rail 81, a fourth wheel 24 that rolls on a traveling surface of the second travel rail 82, and second guide wheels 42 that roll on a guide surface of the guide rail 83. In the present embodiment, one third wheel 23 and one fourth wheel 24 are provided, and two second guide wheels 42 are arranged in a line in the vehicle front-back direction L. The third wheel 23 and the fourth wheel 24 rotate about an axis orthogonal to the vehicle vertical direction H, and the second guide wheels 42 rotate (idle in this example) about respective axes parallel to the vehicle vertical direction H. The third wheel 23 and the fourth wheel 24 are formed to have the same diameter. In the present embodiment, the second travel unit 12 further includes a second drive unit M2 (e.g., an electric motor such as a servomotor) that rotates the third wheel 23 and the fourth wheel 24 at the same speed. The second travel unit 12 travels along the travel rail 80 as a result of the third wheel 23 and the fourth wheel 24 being driven to rotate by the second drive unit M2. Note that a configuration may alternatively be employed in which the second travel unit 12 does not include the second drive unit M2, and the third wheel 23 and the fourth wheel 24 idle.

As shown in FIG. 1, the first travel unit 11 travels in each straight section 71 in an orientation in which the first wheel 21 comes into contact with the first travel rail 81, the second wheel 22 comes into contact with the second travel rail 82, and the first guide wheels 41 do not come into contact with the guide rail 83. The second travel unit 12 travels in each straight section 71 in an orientation in which the third wheel 23 comes into contact with the first travel rail 81, the fourth wheel 24 comes into contact with the second travel rail 82, and the second guide wheels 42 do not come into contact with the guide rail 83. Since the guide rail 83 is not arranged in the straight sections 71, the first guide wheels 41 do not come into contact with the guide rail 83 when the first travel unit 11 travels in the straight sections 71, and the second guide wheels 42 do not come into contact with the guide rail 83 when the second travel unit 12 travels in the straight sections 71.

Assuming that a first target wheel 31A is the first wheel 21 when the target rail 80A is the first travel rail 81, the first target wheel 31A is the second wheel 22 when the target rail 80A is the second travel rail 82, and a first non-target wheel 31B is whichever one of the first wheel 21 and the second wheel 22 is not the first target wheel 31A, the first travel unit 11 travels in the curved section 72 in an orientation in which the first target rail 31A comes into contact with the target rail 80A, the first guide wheels 41 (two first guide wheels 41 in this embodiment) come into contact with the guide rail 83, and the first non-target wheel 31B does not come into contact with the non-target rail 80B, as shown in FIG. 2. Since the first target wheel 31A comes into contact with the target rail 80A and the first guide wheels 41 come into contact with the guide rail 83, the orientation of the first travel unit 11 is maintained as an orientation in which the first non-target wheel 31B does not come into contact with the non-target rail 80B (i.e., an orientation in which the first non-target wheel 31B is spaced apart from the non-target rail 80B) even when the non-target rail 80B is arranged in the curved section 72. In the example shown in FIG. 2, the target rail 80A is the first travel rail 81, and thus the first wheel 21 is the first target wheel 31A, and the second wheel 22 is the first non-target wheel 31B. In the present embodiment, the first target wheel 31A corresponds to a "target wheel", and the first non-target wheel 31B is a "non-target wheel".

Assuming that a second target wheel 32A is the third wheel 23 when the first wheel 21 is the first target wheel 31A, the second target wheel 32A is the fourth wheel 24 when the second wheel 22 is the first target wheel 31A, and a second non-target wheel 32B is whichever one of the third wheel 23 and the fourth wheel 24 is not the second target wheel 32A, the second travel unit 12 travels in the curved section 72 in an orientation in which the second target wheel 32A comes into contact with the target rail 80A, the second guide wheels 42 (two second guide wheels 42 in the present embodiment) come into contact with the guide rail 83, and the second non-target wheel 32B does not come into contact with the non-target rail 80B (not shown in the diagrams). Since the second target wheel 32A comes into contact with the target rail 80A and the second guide wheels 42 come into contact with the guide rail 83, the orientation of the second travel unit 12 is maintained as an orientation in which the second non-target wheel 32B does not come into contact with the non-target rail 80B (i.e., an orientation in which the second non-target wheel 32B is spaced apart from the non-target rail 80B) even when the non-target rail 80B is arranged in the curved section 72. In the example shown in FIGS. 5 and 6, the first wheel 21 is the first target wheel 31A, and thus the third wheel 23 is the second target wheel 32A, and the fourth wheel 24 is the second non-target wheel 32B.

As in the example shown in FIGS. 4 to 6, when the target rail 80A is whichever one of the first travel rail 81 and the second travel rail 82 is arranged on the inner side of the curved section 72 (i.e., in the curved section 72 in which the target rail 80A is located on the inner-circumference side), the first guide wheels 41 and the second guide wheels 42 come into contact with the guide rail 83 from the inner side. On the other hand, when the target rail 80A is whichever one of the first travel rail 81 and the second travel rail 82 is arranged on the outer side of the curved section 72 (i.e., in the curved section 72 in which the target rail 80A is located on the outer-circumferential side), the first guide wheels 41 and the second guide wheels 42 come into contact with the guide rail 83 from the outer side. In the present embodiment, the first travel unit 11 includes a third drive unit M3 (e.g., a solenoid or an electric motor) for moving the first guide wheels 41 in the widthwise direction of the first travel unit 11 (the direction in which the first wheel 21 and the second wheel 22 are arranged), and the second travel unit 12 includes a fourth drive unit M4 (e.g., a solenoid or an electric motor) for moving the second guide wheels 42 in the widthwise direction of the second travel unit 12 (the direction in which the third wheel 23 and the fourth wheel 24 are arranged), as shown in FIG. 1. As a result of the first guide wheels 41 and the second guide wheels 42 being driven by the third drive unit M3 and the fourth drive unit M4, the positions of the first guide wheels 41 and the second guide wheels 42 are switched between positions at which the first guide wheels 41 and the second guide wheels 42 are arranged on the inner side of the guide rail 83 and come into contact with the guide rail 83 from the inner side, and positions at which the first guide wheels 41 and the second guide wheels 42 are arranged on the outer side of the guide rail 83 and come into contact with the guide rail 83 from the outer side.

In the present embodiment, the guide rail 83 is arranged such that the orientation of the transport vehicle 1 in the curved section 72 is an orientation in which the vehicle vertical direction H is parallel to the vertical direction Z as in the straight sections 71. Accordingly, the first travel unit 11 travels in the curved section 72 in an orientation in which the first wheel 21 and the second wheel 22 are arranged at the same height (position in the vertical direction Z) (an orientation in which the later-described first axis A1 is parallel to the vertical direction Z) as shown in FIG. 2, and the second travel unit 12 travels in the curved section 72 in an orientation in which the third wheel 23 and the fourth wheel 24 are arranged at the same height (an orientation in which the later-described second axis A2 is parallel to the vertical direction Z) (not shown in the diagrams). Note that in the example shown in FIG. 2, the non-target rail 80B is arranged at the same height as the target rail 80A in the curved section 72. In the example shown in FIG. 2, a recessed portion that is recessed toward the lower size Z1 is provided along the path-length direction X at a portion of an upper surface of the non-target rail 80B that opposes the first non-target wheel 31B and the second non-target wheel 32B in the vertical direction Z, thereby preventing the first non-target wheel 31B and the second non-target wheel 32B from coming into contact with the non-target rail 80B while causing the transport vehicle 1 to be in an orientation in which the vehicle vertical direction H is parallel to the vertical direction Z in the curved section 72.

Figure 7:
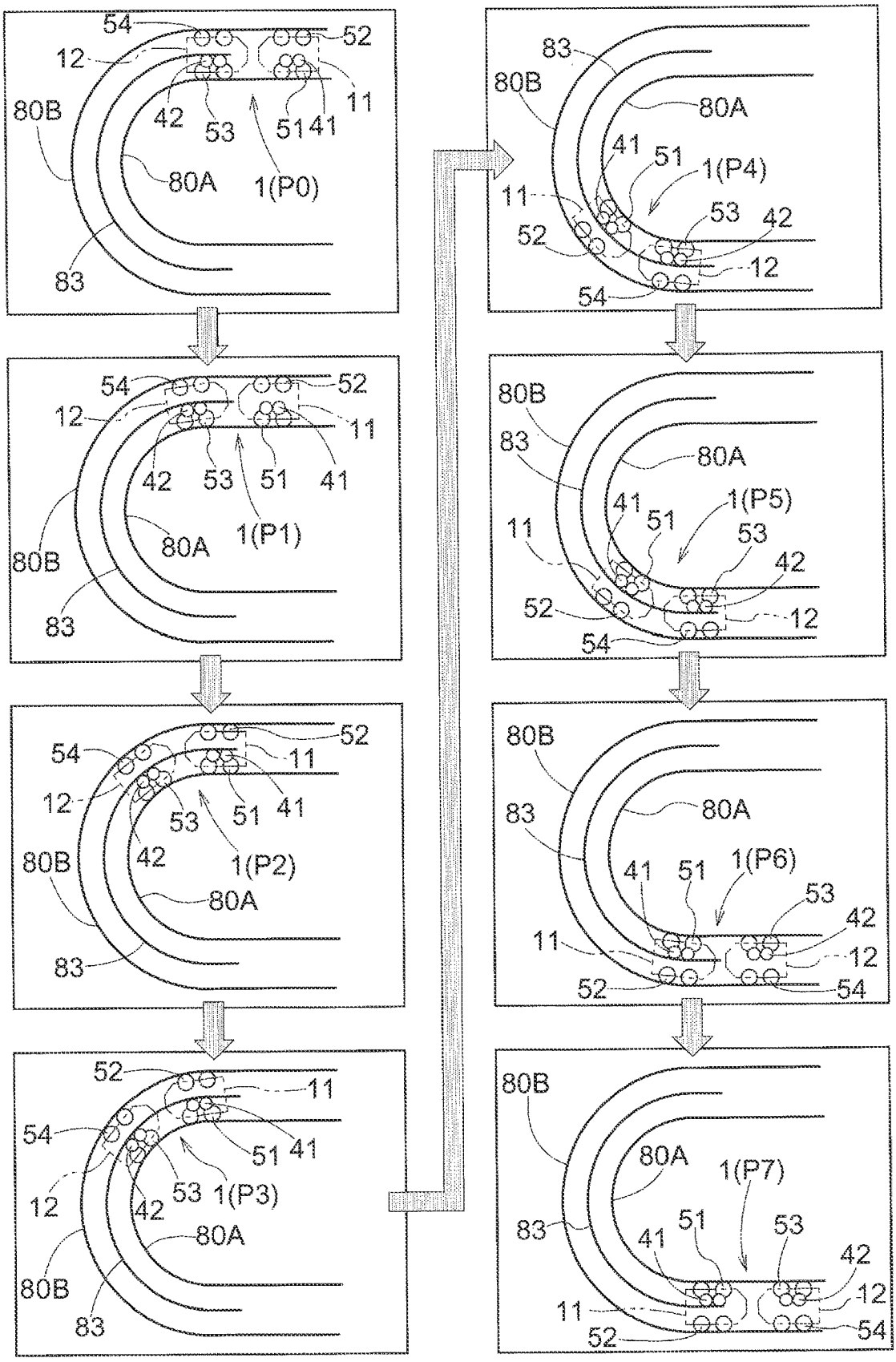
FIG. 7 shows scenes of the transport vehicle passing through the curved section in time series.

In the present embodiment, the first travel unit 11 is connected to the main body portion 13 so as to be able to rotate about the first axis A1 parallel to the vehicle vertical direction H, and the second travel unit 12 is connected to the main body portion 13 so as to be able to rotate about the second axis A2 parallel to the vehicle vertical direction H, as shown in FIGS. 5 and 6. For this reason, when the transport vehicle 1 travels in one straight section 71, the curved section 72, and the other straight section 71 in order, the transport vehicle 1 can smoothly travel while appropriately changing the orientations of the first travel unit 11 and the second travel unit 12 (the orientations thereof about the respective axes parallel to the vehicle vertical direction H), as shown in FIGS. 6 and 7. Note that the first axis A1 and the second axis A2 are both virtual axes, the first axis A1 is arranged at a center position in the widthwise direction (widthwise direction of the first travel unit 11) in the first travel unit 11, and the second axis A2 is arranged at a center position in the widthwise direction (widthwise direction of the second travel unit 12) in the second travel unit 12.

In the present embodiment, the first travel unit 11 includes first auxiliary wheels 51 that roll on a guide surface of the first travel rail 81, and second auxiliary wheels 52 that roll on a guide surface of the second travel rail 82, as shown in FIGS. 2 and 5. The guide surface of the first travel rail 81 and the guide surface of the second travel rail 82 are surfaces (vertical surfaces in this example) that face toward the inner side of the path-width direction Y. In the present embodiment, two first auxiliary wheels 51 are arranged in a line in the vehicle front-back direction L, and two second auxiliary wheels 52 are arranged in a line in the vehicle front-back direction L. Also, in the present embodiment, the second travel unit 12 includes third auxiliary wheels 53 that roll on the guide surface of the first travel unit 81, and fourth auxiliary wheels 54 that roll on the guide surface of the second travel rail 82, as shown in FIG. 5. In the present embodiment, two third auxiliary wheels 53 are arranged in a line in the vehicle front-back direction L, and two fourth auxiliary wheels 54 are arranged in a line in the vehicle front-back direction L.

In a state where the first travel unit 11 is located in any of the straight sections 71, the first auxiliary wheels 51 (two first auxiliary wheels 51 in the present embodiment) come into contact with the first travel rail 81, and the second auxiliary wheels 52 (two second auxiliary wheels 52 in the present embodiment) come into contact with the second travel rail 82, as shown in FIG. 5. Thus, the rotation of the first travel unit 11 about the first axis A1 is restricted by the first travel rail 81 and the second travel rail 82, and the orientation of the first travel unit 11 is maintained as an orientation in which the front-back direction of the first travel unit 11 (the direction orthogonal to both the widthwise direction of the first travel unit 11 and the vehicle vertical direction H) is parallel to the path-length direction X.

It is also assumed that first target auxiliary wheels are the first auxiliary wheels 51 when the first wheel 21 is the first target wheel 31A, and are the second auxiliary wheels 52 when the second wheel 22 is the first target wheel 31A. In a state where the first travel unit 11 is located in the curved section 72, the first target auxiliary wheels (two first target auxiliary wheels in the present embodiment) come into contact with the target rail 80A, and the first guide wheels 41 come into contact with the guide rail 83, as shown in FIG. 2. Thus, the rotation of the first travel unit 11 about the first axis A1 is restricted by the target rail 80A and the guide rail 83, and the orientation of the first travel unit 11 is maintained as an orientation in which the front-back direction of the first travel unit 11 is parallel to the path-length direction X (specifically, a direction that is tangential to the path-length direction X that forms a curved shape). If the non-target rail 80B is arranged in the curved section 72 as in the example shown in FIG. 2, assuming that out of the first auxiliary wheels 51 and the second auxiliary wheels 52, the ones that are not the first target auxiliary wheels are first non-target auxiliary wheels, the rotation of the first travel unit 11 about the first axis A1 is also restricted due to the first non-target auxiliary wheels (two first non-target auxiliary wheels in the present embodiment) coming into contact with the non-target rail 80B.

In a state where the second travel unit 12 is located in any of the straight sections 71, the third auxiliary wheels 53 (two third auxiliary wheels 53 in the present embodiment) come into contact with the first travel rail 81, and the fourth auxiliary wheels 54 (two fourth auxiliary wheels 54 in the present embodiment) come into contact with the second travel rail 82. Thus, the rotation of the second travel unit 12 about the second axis A2 is restricted by the first travel rail 81 and the second travel rail 82, and the orientation of the second travel unit 12 is maintained as an orientation in which the front-back direction of the second travel unit 12 (the direction orthogonal to both the widthwise direction of the second travel unit 12 and the vehicle vertical direction H) is parallel to the path-length direction X.

It is also assumed that second target auxiliary wheels are the third auxiliary wheels 53 when the third wheel 23 is the second target wheel 32A, and are the fourth auxiliary wheels 54 when the fourth wheel 24 is the second target wheel 32A. In a state where the second travel unit 12 is located in the curved section 72, the second target auxiliary wheels (two second target auxiliary wheels in the present embodiment) come into contact with the target rail 80A, and the second guide wheels 42 come into contact with the guide rail 83, as shown in FIG. 6. Thus, the rotation of the second travel unit 12 about the second axis A2 is restricted by the target rail 80A and the guide rail 83, and the orientation of the second travel unit 12 is maintained as an orientation in which the front-back direction of the second travel unit 12 is parallel to the path-length direction X (specifically, a direction that is tangential to the path-length direction X that forms a curved shape). If the non-target rail 80B is arranged in the curved section 72 as in the example shown in FIG. 6, assuming that out of the third auxiliary wheels 53 or the fourth auxiliary wheels 54, the ones that are not the second target auxiliary wheels are second non-target auxiliary wheels, the rotation of the second travel unit 12 about the second axis A2 is also restricted due to the second non-target auxiliary wheels (two second non-target auxiliary wheels in the present embodiment) coming into contact with the non-target rail 80B.

Figure 3:
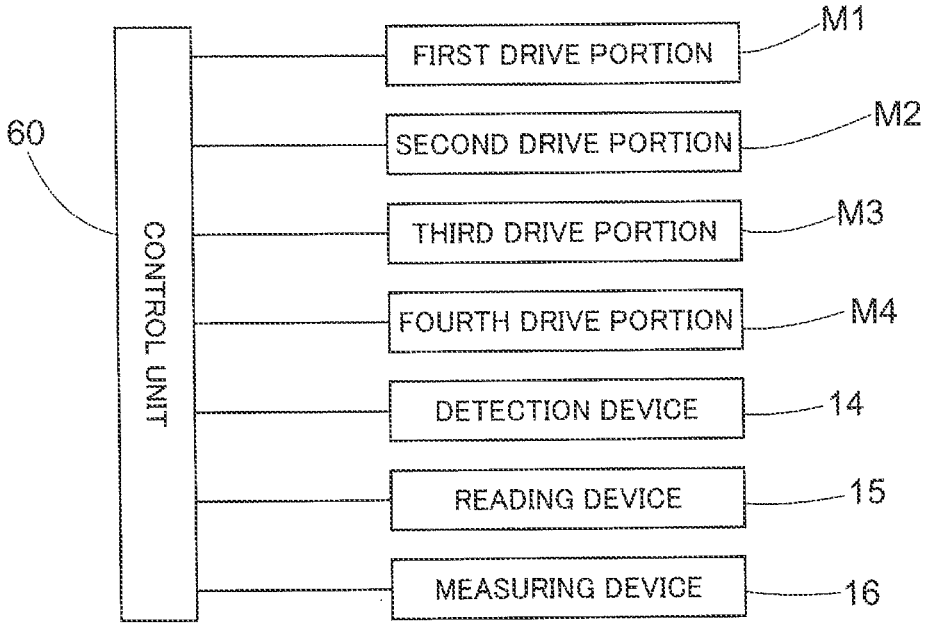
FIG. 3 is a control block diagram.

As shown in FIG. 3, the article transport facility 100 includes a control unit 60. The control unit 60 includes a processor such as a CPU and peripheral circuits such as memories, and functions of the control unit 60 are realized by cooperation between such hardware and programs executed on the hardware such as the processor. The control unit 60 may be provided in the transport vehicle 1 or may be provided independently of the transport vehicle 1. When the control unit 60 includes a plurality of pieces of hardware that are separated in a communicable manner, some pieces of hardware may be provided in the transport vehicle 1, and the remaining pieces of hardware may be provided independently of the transport vehicle 1. Technical features of the control unit 60 disclosed in the present specification are also applicable to the method for controlling the transport vehicle 1 in the article transport facility 100, and the method for controlling the transport vehicle 1 is also disclosed in the present specification.

The control unit 60 controls a traveling operation of the first travel unit 11. In the present embodiment, the control unit 60 further controls a traveling operation of the second travel unit 12. Specifically, the control unit 60 controls the traveling operation of the first travel unit 11 by controlling the driving of the first drive unit M1, and controls the traveling operation of the second travel unit 12 by controlling the driving of the second drive unit M2. When the transport vehicle 1 enters the curved section 72, the control unit 60 switches the positions of the first guide wheels 41 and the second guide wheels 42 in accordance with the structure of the curved section 72 by controlling the driving of the third drive unit M3 and the fourth drive unit M4. Specifically, when the target rail 80A arranged in the curved section 72 to which the transport vehicle 1 is to enter is one of the first travel rail 81 and the second travel rail 82 that is arranged on the inner side of the curved section 72, the control unit 60 moves the first guide wheels 41 and the second guide wheels 42 to positions at which the first and second guide wheels 41 and 42 come into contact with the guide rail 83 from the inner side. When the target rail 80A arranged in the curved section 72 is one of the first travel rail 81 and the second travel rail 82 that is arranged on the outer side of the curved section 72, the control unit 60 moves the first guide wheels 41 and the second guide wheels 42 to positions at which the first and second guide wheels 41 and 42 come into contact with the guide rail 83 from the outer side.

In the present embodiment, the control unit 60 is configured to cause the first travel unit 11 to travel while controlling the rotational speed of the first wheel 21 and the second wheel 22 so as to adjust the rotational speed to a target rotational speed. Specifically, the control unit 60 generates a drive instruction for adjusting the rotational speed of the first wheel 21 and the second wheel 22 to the target rotational speed, and outputs the drive instruction to the first drive unit M1. This drive instruction is a speed instruction or a position instruction. The position instruction is, for example, generated by integrating the speed instruction. The first drive unit M1 includes a motor unit for rotating the first wheel 21 and the second wheel 22, and an amplifier portion for driving the motor unit by performing feedback control so as to follow the drive instruction input from the control unit 60, and rotates the first wheel 21 and the second wheel 22 so as to adjust the rotational speed of the first wheel 21 and the second wheel 22 to the target rotational speed.

In the present embodiment, the control unit 60 is configured to cause the second travel unit 12 to travel so as to follow the traveling of the first travel unit 11. That is to say, the control unit 60 causes the second travel unit 12 to travel so as to follow the traveling of the first travel unit 11 by controlling the state of the third wheel 23 and the fourth wheel 24 being driven by the second drive unit M2 while following the state of the first wheel 21 and the second wheel 22 being driven by the first drive unit M1. For example, the control unit 60 controls driving torque applied to the third wheel 23 and the fourth wheel 24 by the second drive unit M2 such that the second travel unit 12 travels following the traveling of the first travel unit 11. The control unit 60 may alternatively cause the second travel unit 12 to travel so as to follow the traveling of the first travel unit 11 by performing control (torque-free control) such that the driving torque applied to the third wheel 23 and the fourth wheel 24 by second drive unit M2 is zero.

Figure 8:
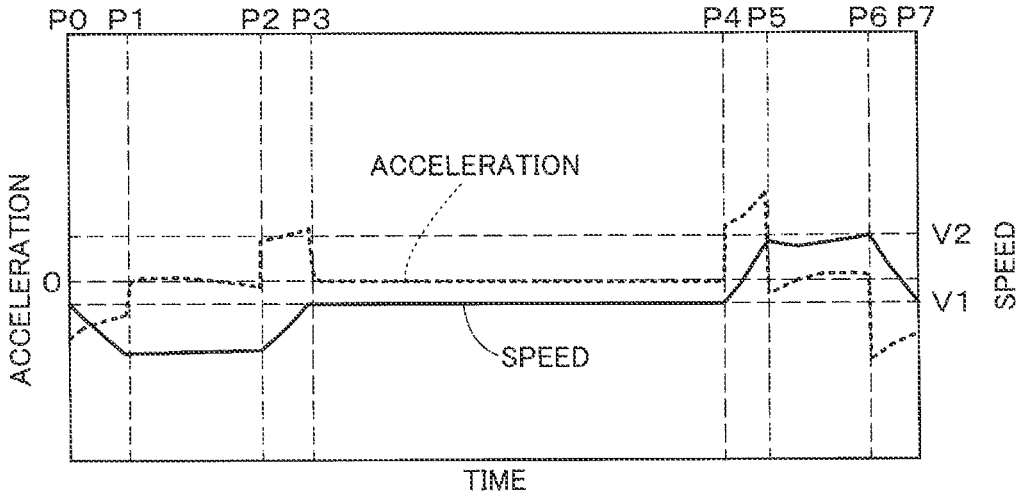
FIG. 8 shows temporal changes in moving speed and moving acceleration of a second target wheel in a comparative example.

If the speed change at a center portion (a center portion in the path-width direction Y, the same follows below) of the transport vehicle 1 is significant when the transport vehicle 1 passes through a boundary B between one straight section 71 and the curved section 72 in the travel path 70, vibration is more likely to occur on the transport vehicle 1 and the article 2 transported by the transport vehicle 1. Here, it is assumed that a boundary B between the curved section 72 and the straight section 71 on the upstream side X2 of the curved section 72 is a first boundary B1, and a boundary B between the curved section 72 and the straight section 71 on the downstream side X1 of the curved section 72 is a second boundary B2, as shown in FIG. 4. If, for example, the rotational speed of the first wheel 21 and the second wheel 22 in the curved section 72 is not changed relative to the rotational speed of the first wheel 21 and the second wheel 22 in the straight section 71, the speed change at the center portion of the transport vehicle 1 becomes significant when the transport vehicle 1 passes through the boundaries B, as indicated by the calculation results shown in FIGS. 8 to 10. Here, it is assumed that the transport vehicle 1 enters and exits the curved section 72 with a fixed curvature as shown in FIGS. 4 to 6. FIG. 8 (and FIG. 11, which will be referred to later) indicates temporal changes in the moving speed and the moving acceleration of the second target wheel 32A, FIG. 9 (and FIG. 12, which will be referred to later) indicates temporal changes in the moving speed and the moving acceleration of the first target wheel 31A, and FIG. 10 (and FIG. 13, which will be referred to later) indicates temporal changes in the moving speed and the moving acceleration of the center portion of the transport vehicle 1 (specifically, a midpoint of a line that connects the first axis A1 and the second axis A2 when viewed in a direction parallel to the vehicle vertical direction H). Note that these moving speeds and the moving accelerations are those in a direction along the travel path 70.

Figure 9:
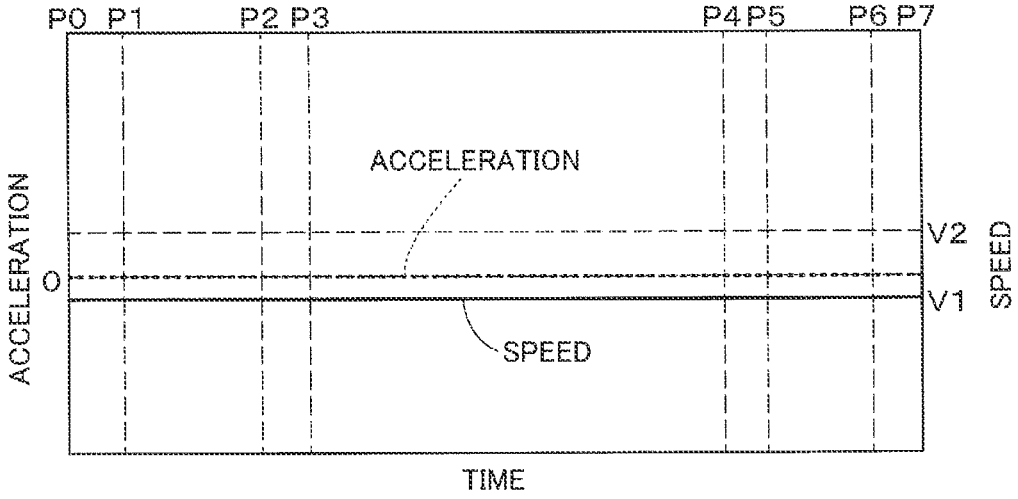
FIG. 9 shows temporal changes in moving speed and moving acceleration of a first target wheel in the comparative example.
Figure 10:
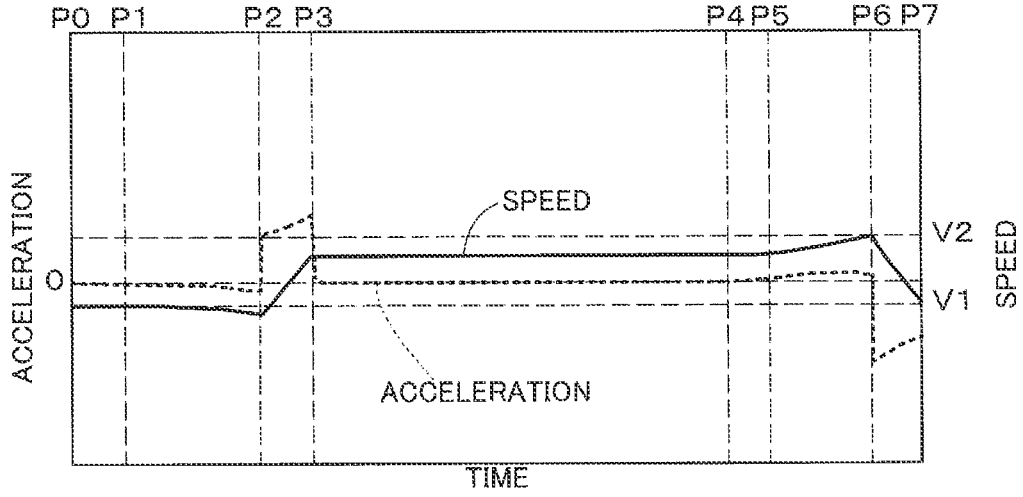
FIG. 10 shows temporal changes in moving speed and moving acceleration of a center portion of the transport vehicle in the comparative example.

During a period from when the transport vehicle 1 enters the curved section 72 until the transport vehicle 1 exits therefrom, the orientation of the transport vehicle 1 changes from a zero-th orientation P0 to a first orientation P1, a second orientation P2, a third orientation P3, a fourth orientation P4, a fifth orientation P5, a sixth orientation P6, and a seventh orientation P7, in this order, as shown in FIG. 7. The zero-th orientation P0 is the orientation of the transport vehicle 1 at the time when the third auxiliary wheel 53 on the front side L1, out of the two third auxiliary wheels 53, reaches the first boundary B1. The first orientation P1 is the orientation of the transport vehicle 1 at the time when the third auxiliary wheel 53 on the back side L2, of the two third auxiliary wheels 53, reaches the first boundary B1. The second orientation P2 is the orientation of the transport vehicle 1 at the time when the first auxiliary wheel 51 on the front side L1, of the two first auxiliary wheels 51, reaches the first boundary B1. The third orientation P3 is the orientation of the transport vehicle 1 at the time when the first auxiliary wheel 51 on the back side L2, of the two first auxiliary wheels 51, reaches the first boundary B1. The fourth orientation P4 is the orientation of the transport vehicle 1 at the time when the third auxiliary wheel 53 on the front side L1, of the two third auxiliary wheels 53, reaches the second boundary B2. The fifth orientation P5 is the orientation of the transport vehicle 1 at the time when the third auxiliary wheel 53 on the back side L2, of the two third auxiliary wheels 53, reaches the second boundary B2. The sixth orientation P6 is the orientation of the transport vehicle 1 at the time when the first auxiliary wheel 51 on the front side L1, of the two first auxiliary wheels 51, reaches the second boundary B2. The seventh orientation P7 is the orientation of the transport vehicle 1 at the time when the first auxiliary wheel 51 on the back side L2, of the two first auxiliary wheels 51, reaches the second boundary B2. In FIGS. 8 to 10, as well as FIGS. 11 to 13 and 16, which will be referred to later, vertical lines are shown at respective points when the orientation of the transport vehicle 1 switches between orientations from the zero-th orientation P0 to the seventh orientation P7. Although FIG. 7 assumes the case where the first wheel 21 is the first target wheel 31A and the third wheel 23 is the second target wheel 32A, if the second wheel 22 is the first target wheel 31A and the fourth wheel 24 is the second target wheel 32A, the orientations of the transport vehicle 1 can be defined similarly to the above by replacing the first auxiliary wheels 51 with the second auxiliary wheels 52 and replacing the third auxiliary wheels 53 with the fourth auxiliary wheels 54 in the above definitions of the orientations.

FIGS. 8 to 10 assume the case where the rotational speed of the first wheel 21 and the second wheel 22 in the straight section 71 is set such that the moving speed of the center portion of the transport vehicle 1 is a first speed V1, and the rotational speed of the first wheel 21 and the second wheel 22 in the curved section 72 is not changed relative to the rotational speed of the first wheel 21 and the second wheel 22 in the straight section 71. For this reason, the rotational speed of the first target wheel 31A is maintained at the rotational speed in the straight section 71 while the orientation of the transport vehicle 1 changes from the zero-th orientation P0 to the seventh orientation P7, and, as a result, the moving speed of the first target wheel 31A that is determined in accordance with the rotational speed of the first target wheel 31A is maintained at the first speed V1, as shown in FIG. 9.

Meanwhile, the moving speed of the center portion of the center portion of the transport vehicle 1 is not maintained at the first speed V1 while the orientation of the transport vehicle 1 changes from the zero-th orientation P0 to the seventh orientation P7, and the moving speed of the center portion of the transport vehicle 1 changes at a relatively large acceleration while the orientation of the transport vehicle 1 changes from the second orientation P2 to the third orientation P3 and while the orientation of the transport vehicle 1 changes from the sixth orientation P6 to the seventh orientation P7, as shown in FIG. 10. Here, since the target rail 80A arranged in the curved section 72 is one of the first travel rail 81 and the second travel rail 82 that is arranged on the inner side of the curved section 72, the moving speed of the center portion of the transport vehicle 1 increases while the orientation of the transport vehicle 1 changes from the second orientation P2 to the third orientation P3, and the moving speed of the center portion of the transport vehicle 1 decreases while the orientation of the transport vehicle 1 changes from the sixth orientation P6 to the seventh orientation P7. However, if the target rail 80A arranged in the curved section 72 is one of the first travel rail 81 and the second travel rail 82 that is arranged on the outer side of the curved section 72, the moving speed of the center portion of the transport vehicle 1 decreases while the orientation of the transport vehicle 1 changes from the second orientation P2 to the third orientation P3, and the moving speed of the center portion of the transport vehicle 1 increases while the orientation of the transport vehicle 1 changes from the sixth orientation P6 to the seventh orientation P7.

When, as shown in FIG. 4, the length of the curved section 72 along the travel path 70 at the center portion 70*a* in the path-width direction Y of the travel path 70 is a first length D1, and the length of the target rail 80A along the travel path 70 is a second length D2, the ratio of the second length D2 to the first length D1 (i.e., the ratio with the first length D1 as the denominator and the second length D2 as the numerator; in other words, a value obtained by dividing the second length D2 by the first length D1) is the same as or similar to the ratio of the moving speed of the first target wheel 31A to the moving speed of the center portion of the transport vehicle 1 in the curved section 72. In view of this point, the control unit 60 of the present embodiment is configured to change the rotational speed of the first wheel 21 and the second wheel 22 in the curved section 72 relative to the rotational speed of the first wheel 21 and the second wheel 22 in the straight section 71 in accordance with the ratio of the second length D2 to the first length D1. Thus, it is possible to reduce the speed change at the center portion of the transport vehicle 1 when passing through the boundaries B and reduce vibration that may occur on the transport vehicle 1 and the article 2 transported by the transport vehicle 1, as indicated by the calculation results shown in FIGS. 11 to 13. Note that, in the curved section 72 with a fixed curvature as in the example shown in FIG. 4, the ratio of the second length D2 to the first length D1 can be determined based on the curvature radius of the curved section 72 (e.g., the curvature radius at the center portion 70*a* of the travel path 70) and the gap in the widthwise direction (the widthwise direction of the first travel unit 11) between the first wheel 21 and the second wheel 22. Note that, in the present embodiment, the gap in the widthwise direction (the widthwise direction of the second travel unit 12) between the third wheel 23 and the fourth wheel 24 is equal to the gap in the widthwise direction (the widthwise direction of the first travel unit 11) between the first wheel 21 and the second wheel 22.

Figure 11:
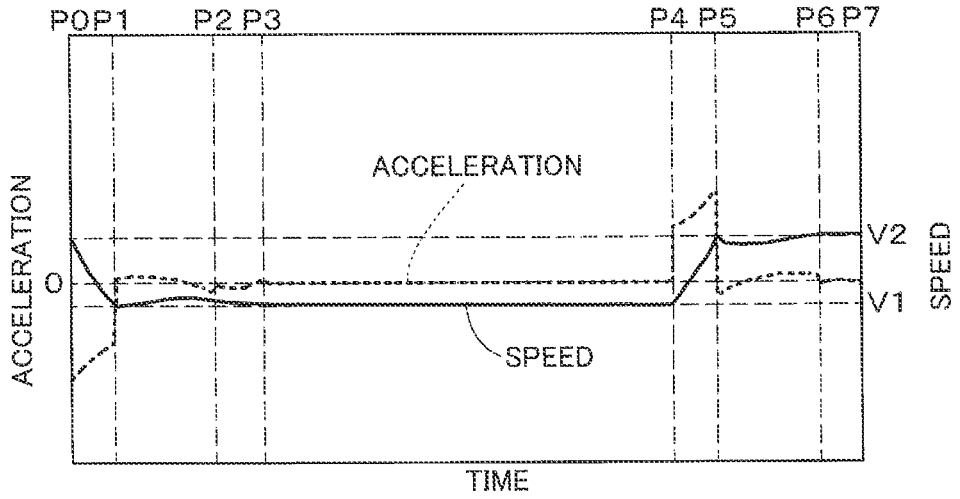
FIG. 11 shows temporal changes in the moving speed and the moving acceleration of the second target wheel according to an embodiment.
Figure 12:
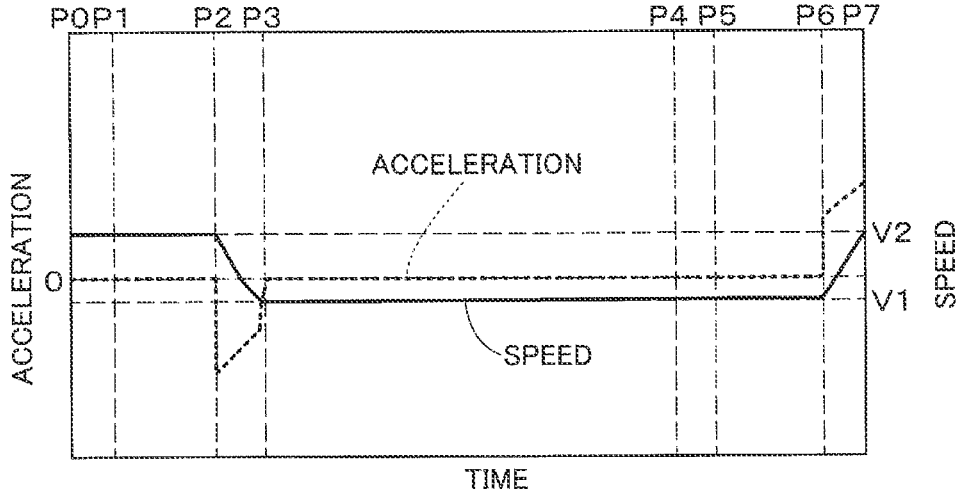
FIG. 12 shows temporal changes in the moving speed and the moving acceleration of the first target wheel according to the embodiment.
Figure 13:
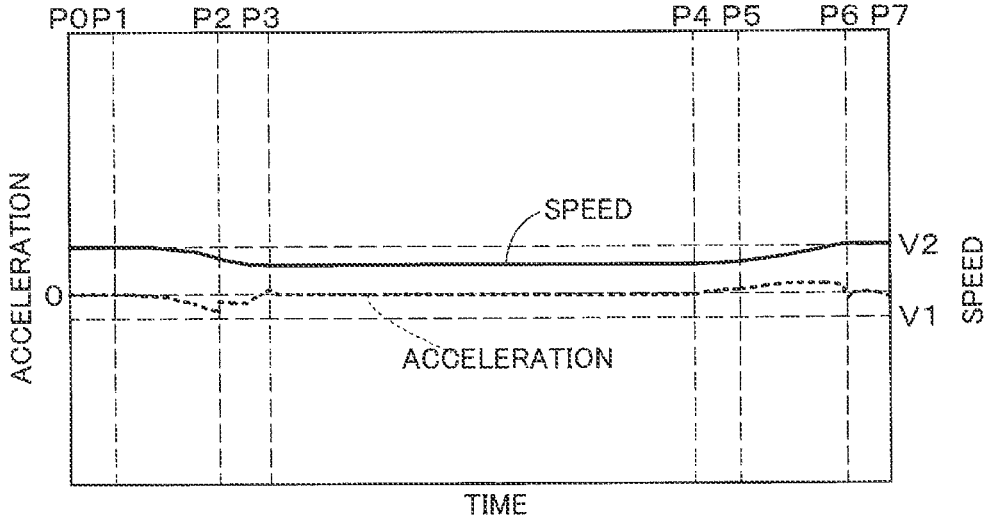
FIG. 13 shows temporal changes in the moving speed and the moving acceleration of the center portion of the transport vehicle according to the embodiment.

FIGS. 11 to 13 assume the case where the control unit 60 sets the rotational speed of the first wheel 21 and the second wheel 22 in the curved section 72 when the transport vehicle 1 travels at a set speed, to a speed obtained by multiplying the rotational speed of the first wheel 21 and the second wheel 22 when the transport vehicle 1 travels in the straight section 71 at this set speed by a value obtained by dividing the second length D2 by the first length D1. Specifically, the rotational speed of the first wheel 21 and the second wheel 22 in the straight section 71 is set to a rotational speed (hereinafter referred to as a "reference rotational speed") at which the moving speed of the center portion of the transport vehicle 1 is the second speed V2. Meanwhile, the rotational speed of the first wheel 21 and the second wheel 22 in the curved section 72 is set to the rotational speed obtained by multiplying the reference rotational speed by the value obtained by dividing the second length D2 by the first length D1. Here, the second speed V2 is set such that the speed obtained by multiplying the second speed V2 by the value obtained by dividing the second length D2 by the first length D1 is the first speed V1. For this reason, the moving speed of the first target wheel 31A in the curved section 72 (here, the period in which the orientation of the transport vehicle 1 changes from the third orientation P3 to the sixth orientation P6) is the first speed V1, as shown in FIG. 12. Here, it is assumed that the value obtained by dividing the second length D2 by the first length D1 is 0.75, and a relationship in which $V1=V2\times0.75$ holds.

By setting the rotational speed of the first wheel 21 and the second wheel 22 in the curved section 72 as described above, the moving speed of the center portion of the transport vehicle 1 in the curved section 72 can be brought close to the moving speed (here, the second speed V2) of the center portion of the transport vehicle 1 in the straight section 71, as shown in FIG. 13. As a result, the speed change at the center portion of the transport vehicle 1 when passing through the boundaries B can be reduced. As a result of thus enabling the moving speed of the center portion of the transport vehicle 1 in the curved section 72 to be brought close to the moving speed (here, the second speed V2) of the center portion of the transport vehicle 1 in the straight section 71, it is possible to keep a high moving speed in the straight section 71 while preventing the moving speed in the curved section 72 from excessively increasing when the transport vehicle 1 travels in one straight section 71, the curved section 72, and the other straight section 71 in this order. As a result, the time required for the transport vehicle 1 to travel through the travel path 70 can also be shortened.

Here, a description has been given for an example case where, in order to change the rotational speed of the first wheel 21 and the second wheel 22 in the curved section 72 (hereinafter referred to as a "curved-section rotational speed") relative to the rotational speed of the first wheel 21 and the second wheel 22 in the straight section 71 (hereinafter referred to as a "straight-section rotational speed") in accordance with the ratio of the second length D2 to the first length D1, the curved-section rotational speed is set to a speed obtained by multiplying the straight-section rotational speed by a value (hereinafter referred to as a "division value") obtained by dividing the second length D2 by the first length D1. However, the present invention is not limited to the present configuration, and the curved-section rotational speed may alternatively be changed from the straight-section rotational speed in accordance with the ratio of the second length D2 to the first length D1 by setting the curved-section rotational speed to a speed obtained by multiplying the straight-section rotational speed by a value that corresponds to the division value but differs from the division value. The value corresponding to the division value can be a value obtained by multiplying the division value by a correction coefficient, for example. This correction coefficient can be, for example, a coefficient based on a length of the transport vehicle 1 that affects traveling characteristics thereof (e.g., the gap between first axis A1 and the second axis A2 when viewed in a direction parallel to the vehicle vertical direction H).

As described above, the control unit 60 is configured to change the curved-section rotational speed from the straight-section rotational speed so as to bring the moving speed of the center portion of the transport vehicle 1 in the curved section 72 close to the moving speed of the center portion of the transport vehicle 1 in the straight section 71 (the second speed V2 in the example shown in FIG. 13). Unlike the example shown in FIG. 13, the control unit 60 may be configured to change the curved-section rotational speed from the straight-section rotational speed so as to match the moving speed of the center portion of the transport vehicle 1 in the curved section 72 to the moving speed of the center portion of the transport vehicle 1 in the straight section 71.

To smooth the speed change at the center portion of the transport vehicle 1 when passing through the boundaries B, in the present embodiment, the control unit 60 is configured to start changing the rotational speed of the first wheel 21 and the second wheel 22 in accordance with the timing at which the first travel unit 11 enters the curved section 72 from one straight section 71 and the timing at which the first travel unit 11 enters the other straight section 71 from the curved section 72. In the present embodiment, the orientation of the transport vehicle 1 switches to the second orientation P2 at the timing at which the first travel unit 11 enters the curved section 72 from one straight section 71, and the orientation of the transport vehicle 1 switches to the sixth orientation P6 at the timing at which the first travel unit 11 enters the other straight section 71 from the curved section 72, as shown in FIG. 7. Therefore, the control unit 60 starts changing the rotational speed of the first wheel 21 and the second wheel 22 from the straight-section rotational speed to the curved-section rotational speed at the timing at which the orientation of the transport vehicle 1 switches to the second orientation P2, and starts changing the rotational speed of the first wheel 21 and the second wheel 22 from the curved-section rotational speed to the straight-section rotational speed at the timing at which the orientation of the transport vehicle 1 switches to the sixth orientation P6. In the present embodiment, the control unit 60 changes the rotational speed of the first wheel 21 and the second wheel 22 from the straight-section rotational speed to the curved-section rotational speed such that the rotational speed of the first wheel 21 and the second wheel 22 reaches the curved-section rotational speed at the timing at which the orientation of the transport vehicle 1 switches to the third orientation P3, and changes the rotational speed of the first wheel 21 and the second wheel 22 from the curved-section rotational speed to the straight-section rotational speed such that the rotational speed of the first wheel 21 and the second wheel 22 reaches the straight-section rotational speed at the timing at which the orientation of the transport vehicle 1 switches to the seventh orientation P7.

Since the control unit 60 changes the rotational speed of the first wheel 21 and the second wheel 22 as described above, in the example shown in FIG. 12, the moving speed of the first target wheel 31A that is determined in accordance with the rotational speed of the first target wheel 31A is maintained at the second speed V2 until the orientation of the transport vehicle 1 switches to the second orientation P2, changes from the second speed V2 to the first speed V1 while the orientation of the transport vehicle 1 changes from the second orientation P2 to the third orientation P3, is maintained at the first speed V1 while the orientation of the transport vehicle 1 changes from the third orientation P3 to the sixth orientation P6, and changes from the first speed V1 to the second speed V2 while the orientation of the transport vehicle 1 changes from the sixth orientation P6 to the seventh orientation P7.

As described above, in the present embodiment, the control unit 60 starts changing the rotational speed of the first wheel 21 and the second wheel 22 from the straight-section rotational speed to the curved-section rotational speed at the timing at which the orientation of the transport vehicle 1 switches to the second orientation P2, and starts changing the rotational speed of the first wheel 21 and the second wheel 22 from the curved-section rotational speed to the straight-section rotational speed at the timing at which the orientation of the transport vehicle 1 switches to the sixth orientation P6. In the present embodiment, the control unit 60 is configured to determine the timings at which the orientation of the transport vehicle 1 switches to the second orientation P2 and to the sixth orientation P6 as follows.

In the present embodiment, detected bodies 3 are provided at positions corresponding to the boundaries B (see FIG. 4) on the travel path 70 as shown in FIG. 5, and the transport vehicle 1 includes detection devices 14 for detecting the detected bodies 3 as shown in FIG. 3. For example, each detected body 3 may be a reflective tape that reflects light, and each detection device 14 may be a reflective optical sensor. In the example shown in FIG. 2, the detected bodies 3 are provided on a lower surface of the target rail 80A, and the detection devices 14 are provided at upper portions of the main body portion 13. In the example shown in FIG. 2, a detection device 14 to be used when the first travel rail 81 is the target rail 80A and a detection device 14 to be used when the second travel rail 82 is the target rail 80A are separately provided.

In the present embodiment, the detected body 3 provided at the position corresponding to the first boundary B1 is provided at a position that is detected by the detection device 14 in a state where the transport vehicle 1 is located at a position at which the orientation of the transport vehicle 1 is the second orientation P2. The detected body 3 provided at the position corresponding to the second boundary B2 is provided at a position that is detected by the detection device 14 in a state where the transport vehicle 1 is located at a position at which the orientation of the transport vehicle 1 is the sixth orientation P6. Note that the detected bodies 3 may alternatively be provided further on the upstream side X2 of the travel path 70 than the aforementioned positions by a distance corresponding to a control delay.

Further, in the present embodiment, an information holder 4 for holding address information indicating a position on the upstream side X2 of a boundary B in the travel path 70 is provided at this position, as shown in FIG. 5, and the transport vehicle 1 includes a reading device 15 for reading the address information held by the information holder 4, and a measuring device 16 for measuring the travel distance of the first travel unit 11, as shown in FIG. 3. The information holder 4 holds address information indicating the position at which this information holder 4 is provided (information indicating a position along the travel path 70). For example, the information holder 4 may be a one-dimensional code or a two-dimensional code, and the reading device 15 may be a one-dimensional code reader or a two-dimensional code reader. In the example shown in FIG. 5, the information holder 4 is provided in the straight section 71. The information holder 4 is provided on a lower surface of the first travel rail 81 or the second travel rail 82, for example. Also, for example, the measuring device 16 may be a rotary encoder.

The control unit 60 derives an estimated current position, which is the current estimated position of the first travel unit 11 based on the address information read by the reading device 15 and the travel distance of the first travel unit 11 measured by the measuring device 16 (specifically, the distance that the transport vehicle 1 has traveled since the reading device 15 read the address information). The estimated current position is the current estimated position of the first travel unit 11 in the path-length direction X. The estimated current position may be, for example, the position of the first target wheel 31A, which is either the first wheel 21 or the second wheel 22, or the positions of the first target auxiliary wheels, which are either the first auxiliary wheels 51 or the second auxiliary wheels 52.

If a first condition or a second condition is satisfied, the control unit 60 determines that the first travel unit 11 has reached a boundary B and starts changing the rotational speed of the first wheel 21 and the second wheel 22. Assuming that a region extending along the travel path 70 on both sides of each boundary B (a region extending in the path-length direction X) is a boundary region C (see FIG. 4), the first condition is that the estimated current position of the first travel unit 11 is a position within the boundary region C and that the detected body 3 has been detected by the detection device 14, and the second condition is that, after the estimated current position of the first travel unit 11 entered the boundary region C, this estimated current position has reached an end portion on the downstream side X1 of the boundary region C on the travel path 70 without the detected body 3 being detected by the detection device 14. Note that the first condition may simply be that the estimated current position of the first travel unit 11 is a position within the boundary region C (i.e., that the estimated current position of the first travel unit 11 has entered the boundary region C). Further, the first condition may simply be that the detected body 3 has been detected by the detection device 14.

In the present embodiment, two boundary regions C are defined, namely a first boundary region C1, which is a region extending from the first boundary B1 on both sides along the travel path 70, and a second boundary region C2, which is a region extending from the second boundary B2 on both sides along the travel path 70. The control unit 60 determines whether the first condition or the second condition is satisfied while regarding the first boundary region C1 as the boundary region C. If the first condition or the second condition is satisfied, the control unit 60 determines that the first travel unit 11 has reached the first boundary B1 (i.e., determines that the orientation of the transport vehicle 1 has switched to the second orientation P2), and starts changing the rotational speed of the first wheel 21 and the second wheel 22 from the straight-section rotational speed to the curved-section rotational speed. Further, the control unit 60 determines whether the first condition or the second condition is satisfied while regarding the second boundary region C2 as the boundary region C. If the first condition or the second condition is satisfied, the control unit 60 determines that the first travel unit 11 has reached the second boundary B2 (i.e., determines that the orientation of the transport vehicle 1 has switched to the sixth orientation P6), and starts changing the rotational speed of the first wheel 21 and the second wheel 22 from the curved-section rotational speed to the straight-section rotational speed.

Figure 14:
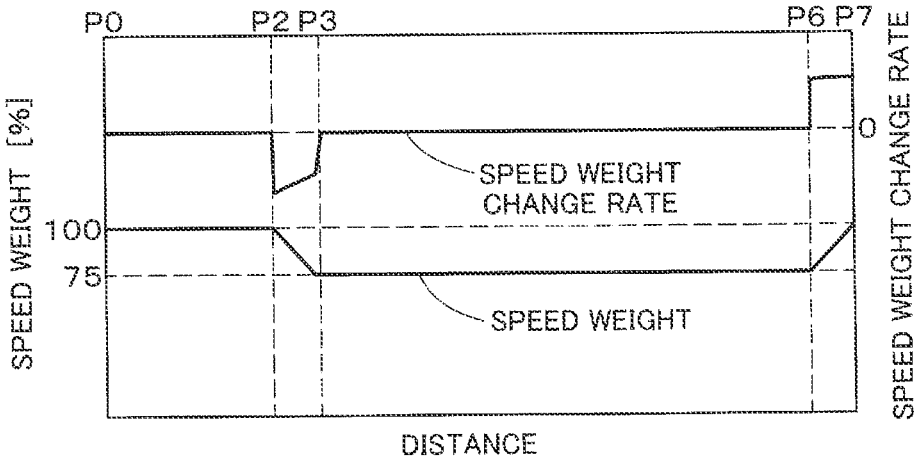
FIG. 14 shows an example of speed weight and a change rate of the speed weight.
Figure 15:
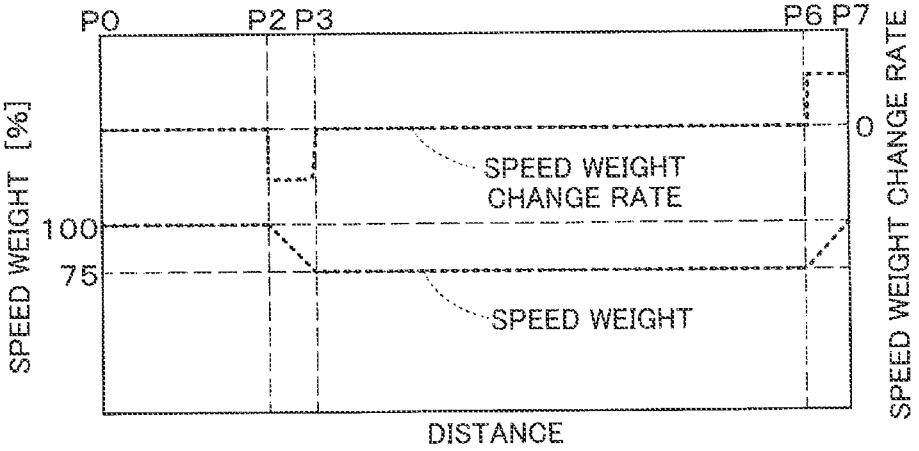
FIG. 15 shows another example of the speed weight and the change rate of the speed weight.

In the present embodiment, the control unit 60 is configured to set the curved-section rotational speed based on the straight-section rotational speed, using a speed weight function (speed weight table) that is prepared in advance, examples of which are shown in FIGS. 14 and 15. The speed weight function indicates a speed weight (a proportion of the curved-section rotational speed to the straight-section rotational speed) at each position in the curved section 72, and the horizontal axes in FIGS. 14 and 15 indicate the distance from a reference position along the travel path 70 (i.e., the position in the path-length direction X). The curved-section rotational speed at each position in the curved section 72 can be derived by multiplying the straight-section rotational speed by the speed weight function. The speed weight function can be prepared by calculation based on parameters related to the shape of the curved section 72 and parameters related to the structure of the transport vehicle 1. The parameters related to the shape of the curved section 72 include the curvature radius, for example, and the parameters related to the structure of the transport vehicle 1 include, for example, the gap in the widthwise direction (the widthwise direction of the first travel unit 11) between the first wheel 21 and the second wheel 22, and the gap between the first axis A1 and the second axis A2 when viewed in a direction parallel to the vehicle vertical direction H. Note that the control unit 60 may alternatively be configured to calculate and set the curved-section rotational speed, when necessary, without using such a speed weight function.

The speed weight functions shown in FIGS. 14 and 15 indicate the speed weight functions in the case of changing the moving speed of the first target wheel 31A as shown in FIG. 12, and assume that the value obtained by dividing the second length D2 by the first length D1 is 0.75. For this reason, with the speed weight functions shown in FIGS. 14 and 15, the speed weight in a section between the position at which the orientation of the transport vehicle 1 switches to the third orientation P3 and the position at which the orientation of the transport vehicle 1 switches to the sixth orientation P6 is 75%. The speed weight is maintained at 100% until the orientation of the transport vehicle 1 switches to the second orientation P2, changes from 100% to 75% while the orientation of the transport vehicle 1 changes from the second orientation P2 to the third orientation P3, is maintained at 75% while the orientation of the transport vehicle 1 changes from the third orientation P3 to the sixth orientation P6, and changes from 75% to 100% while the orientation of the transport vehicle 1 changes from the sixth orientation P6 to the seventh orientation P7.

In the example shown in FIG. 14, as FIG. 14 indicates the change rate of the speed weight (the change rate relative to the distance) together with the speed weight, the speed weight is changed while changing the change rate of the speed weight in a section between the position at which the orientation of the transport vehicle 1 switches to the second orientation P2 and the position at which the orientation of the transport vehicle 1 switches to the third orientation P3, and a section between the position at which the orientation of the transport vehicle 1 switches to the sixth orientation P6 and the position at which the orientation of the transport vehicle 1 switches to the seventh orientation P7. Although not shown in the diagram, in FIG. 14, the speed weight is changed such that the change rate of the change rate of the speed weight (i.e., the second-order differential value of the speed weight) is constant. For this reason, in the case of using the speed weight function shown in FIG. 14, the rotational speed of the first wheel 21 and the second wheel 22 changes such that the second-order differential value of this rotational speed is constant (here, constant at a value other than zero) when the control unit 60 changes the rotational speed of the first wheel 21 and the second wheel 22 between the straight-section rotational speed, which is the rotational speed in the straight sections 71, and the curved-section rotational speed, which is the rotational speed in the curved section 72. Note that the second-order differential value of the rotational speed here is a second-order differential value relative to the distance, or a second-order differential value relative to the time.

Further, in the example shown in FIG. 15, as FIG. 15 indicates the change rate of the speed weight (the change rate relative to the distance) together with the speed weight, the speed weight is changed such that the change rate of the speed weight is constant in a section between the position at which the orientation of the transport vehicle 1 switches to the second orientation P2 and the position at which the orientation of the transport vehicle 1 switches to the third orientation P3, and a section between the position at which the orientation of the transport vehicle 1 switches to the sixth orientation P6 and the position at which the orientation of the transport vehicle 1 switches to the seventh orientation P7. For this reason, in the case of using the speed weight function shown in FIG. 15, the rotational speed of the first wheel 21 and the second wheel 22 changes such that the first-order differential value of this rotational speed is constant when the control unit 60 changes the rotational speed of the first wheel 21 and the second wheel 22 between the straight-section rotational speed, which is the rotational speed in the straight section 71, and the curved-section rotational speed, which is the rotational speed in the curved section 72. Note that the first-order differential value of the rotational speed here is a first-order differential value relative to the distance, or a first-order differential value relative to the time.

Figure 16:
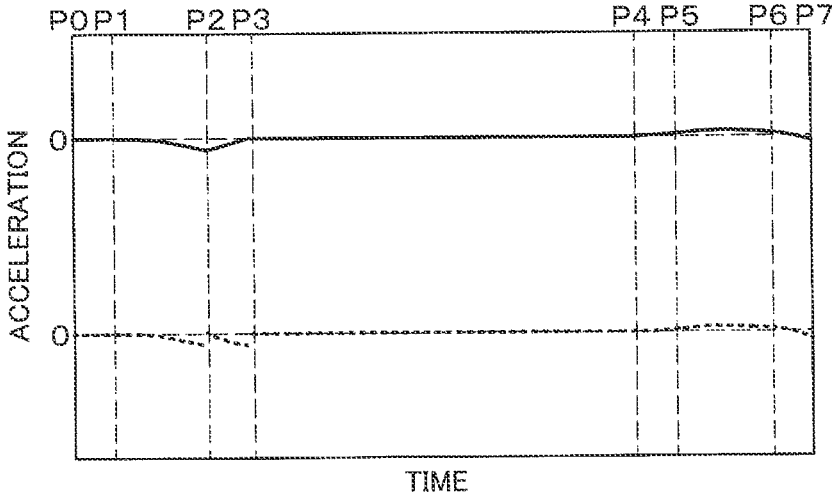
FIG. 16 shows temporal changes in the moving acceleration of the center portion of the transport vehicle corresponding to FIGS. 14 and 15.

In FIG. 16, the temporal change in the moving acceleration of the center portion of the transport vehicle 1 in the case of using the speed weight function shown in FIG. 14 is indicated by a solid line, and the temporal change in the moving acceleration of the center portion of the transport vehicle 1 in the case of using the speed weight function shown in FIG. 15 is indicated by a broken line. It can be understood from FIG. 16 that, in the case of using the speed weight function shown in FIG. 14, the rotational speed of the first wheel 21 and the second wheel 22 can be more easily changed so as to smooth the change in the moving acceleration of the center portion of the transport vehicle 1 than in the case of using the speed weight function shown in FIG. 15. Note that, even in the case of using the speed weight function shown in FIG. 15, the change in the moving acceleration of the center portion of the transport vehicle 1 can be reduced compared with the comparative example shown in FIG. 10.

Other Embodiments

Next, other embodiments of the article transport facility will be described.

(1) The above embodiment has described, as an example, a configuration in which the control unit 60 determines that the first travel unit 11 has reached a boundary B and starts changing the rotational speed of the first wheel 21 and the second wheel 22 if the first condition or the second condition is satisfied. However, the present disclosure is not limited to the present configuration, and for example, a configuration may alternatively be employed in which the control unit 60 determines that the first travel unit 11 has reached a boundary B and starts changing the rotational speed of the first wheel 21 and the second wheel 22 only if the first condition is satisfied.

A configuration is also possible in which the control unit 60 determines whether or not the first travel unit 11 has reached a boundary B without using either the first condition or the second condition. When the transport vehicle 1 enters the curved section 72 from one straight section 71, the moving speed of the second target wheel 32A decreases from the second speed V2 with the moving speed of the first target wheel 31A maintained at the second speed V2 after the point when the orientation of the transport vehicle 1 switches to the zero-th orientation P0, as shown in FIGS. 11 and 12. Further, when the transport vehicle 1 enters the other straight section 71 from the curved section 72, the moving speed of the second target wheel 32A increases from the first speed V1 with the moving speed of the first target wheel 31A maintained at the first speed V1 after the point when the orientation of the transport vehicle 1 switches to the fourth orientation P4. In view of this point, for example, a configuration may be employed in which the control unit 60 determines that the first travel unit 11 has reached a boundary B and starts changing the rotational speed of the first wheel 21 and the second wheel 22 at the point when the first travel unit 11 has traveled a distance corresponding to the gap in the vehicle front-back direction L between the first target wheel 31A and the second target wheel 32A since the control unit 60 detected a change in the rotational speed of the second target wheel 32A relative to the rotational speed of the first target wheel 31A. The change in the rotational speed of the second target wheel 32A relative to the rotational speed of the first target wheel 31A can be detected at a point before the rotational speed of the first wheel 21 and the second wheel 22 starts being changed. With the present configuration, it is easy to start changing the rotational speed of the first wheel 21 and the second wheel 22 at an intended timing even if a control delay occurs.

Specifically, the control unit 60 can be configured as follows. That is to say, the control unit 60 determines that the first travel unit 11 has reached the first boundary B1 and starts changing the rotational speed of the first wheel 21 and the second wheel 22 from the straight-section rotational speed to the curved-section rotational speed, at the point when the first travel unit 11 has traveled a distance corresponding to the gap in the vehicle front-back direction L between the first target wheel 31A and the second target wheel 32A (the distance that the first travel unit 11 travels while the orientation of the transport vehicle 1 changes from the zero-th orientation P0 to the second orientation P2 in the example shown in FIG. 7) since the control unit 60 detected a change (a decrease in the curved section 72 in which the target rail 80A is located on the inner-circumferential side, and an increase in the curved section 72 in which the target rail 80A is located on the outer-circumferential side) in the rotational speed of the second target wheel 32A relative to the rotational speed of the first target wheel 31A. Further, the control unit 60 determines that the first travel unit 11 has reached the second boundary B2 and starts changing the rotational speed of the first wheel 21 and the second wheel 22 from the curved-section rotational speed to the straight-section rotational speed, at the point when the first travel unit 11 has traveled a distance corresponding to the gap in the vehicle front-back direction L between the first target wheel 31A and the second target wheel 32A (the distance that the first travel unit 11 travels while the orientation of the transport vehicle 1 changes from the fourth orientation P4 to the sixth orientation P6 in the example shown in FIG. 7) since the control unit 60 detected a change (an increase in the curved section 72 in which the target rail 80A is located on the inner-circumferential side, and a decrease in the curved section 72 in which the target rail 80A is located on the outer-circumferential side) in the rotational speed of the second target wheel 32A relative to the rotational speed of the first target wheel 31A.

(2) The above embodiment has described, as an example, a configuration in which the second travel unit 12 is arranged on the front side L1 of the first travel unit 11. However, the present disclosure is not limited to the present configuration, and a configuration may alternatively be employed in which the second travel unit 12 is arranged on the back side L2 of the first travel unit 11.

(3) The above embodiment has described, as an example, a configuration in which the transport vehicle 1 includes the second travel unit 12. However, the present disclosure is not limited to the present configuration, and a configuration may alternatively be employed in which the transport vehicle 1 does not include the second travel unit 12. In this case, the first travel unit 11 may be connected to the main body portion 13 so as to be not able to rotate about an axis parallel to the vehicle vertical direction H.

(4) Note that the configurations disclosed in the above embodiment can also be applied in combination with configurations disclosed in the other embodiments (including combinations of the embodiments described as the other embodiments) unless inconsistency occurs. Regarding other configurations as well, the embodiment disclosed in the present specification is merely an example in all respects. Accordingly, various modifications can be made as appropriate, without departing from the gist of the present disclosure.

Summary of the Above Embodiment

The summary of the above-described article transport facility will be described below.

An article transport facility includes: travel rails arranged along a travel path; a transport vehicle configured to travel along the travel rails and transport an article; and a control unit configured to control a traveling operation of a travel unit included in the transport vehicle, wherein the travel path includes a straight section that is formed in a straight shape in a plan view, and a curved section that is formed in a curved shape in a plan view, in the straight section, a first travel rail and a second travel rail among the travel rails are arranged separately on respective sides of a center portion in a widthwise direction of the travel path, and in the curved section, assuming that one out of the first travel rail and the second travel rail is a target rail and the other one is a non-target rail, at least the target rail, out of the target rail and the non-target rail, is arranged, and a guide rail that is different from the target rail and the non-target rail is also arranged along the travel path, the travel unit includes a first wheel configured to roll on a traveling surface of the first travel rail, a second wheel configured to roll on a traveling surface of the second travel rail, a drive unit configured to rotate the first wheel and the second wheel at the same speed, and a guide wheel configured to roll on a guide surface of the guide rail, assuming that a target wheel is the first wheel when the target rail is the first travel rail, the target wheel is the second wheel when the target rail is the second travel rail, and a non-target wheel is whichever one of the first wheel and the second wheel is not the target wheel, the travel unit travels in the curved section in an orientation in which the target wheel comes into contact with the target rail, the guide wheel comes into contact with the guide rail, and the non-target wheel does not come into contact with the non-target rail, and the control unit changes a rotational speed of the first wheel and the second wheel in the curved section relative to a rotational speed of the first wheel and the second wheel in the straight section in accordance with a ratio of a second length, which is a length of the target rail along the travel path, to a first length, which is a length of the curved section along the travel path at the center portion in the widthwise direction of the travel path.

According to the present configuration, the orientation of the travel unit when traveling in the curved section is an orientation in which the target wheel comes into contact with the target rail, the guide wheel comes into contact with the guide rail, and the non-target wheel does not come into contact with the non-target rail. As a result, the transport vehicle can appropriately travel with the target wheel and the non-target wheel rotated at the same speed in the curved section in which the length of the movement trajectory of the target wheel differs from the length of the movement trajectory of the non-target wheel. That is to say, according to the present configuration, the transport vehicle can appropriately travel in the curved section when the two left and right wheels of the transport vehicle are driven to rotate at the same speed.

Further, in the present configuration, the rotational speed of the first wheel and the second wheel in the curved section changes relative to the rotational speed of the first wheel and the second wheel in the straight section, in accordance with the ratio of the second length to the first length. Here, the ratio of the second length to the first length is the same as or similar to the ratio of the moving speed of the target wheel to the moving speed of a center portion (a center portion in the widthwise direction; the same follows below) of the transport vehicle. For this reason, the moving speed of the center portion of the transport vehicle in the curved section can be brought close to the moving speed of the center portion of the transport vehicle in the straight section by setting the rotational speed of the first wheel and the second wheel in the curved section as described above. As a result, it is possible to reduce a speed change at the center portion of the transport vehicle when passing through a boundary between the straight section and the curved section, and to reduce vibration that may occur on the transport vehicle and the article transported by the transport vehicle.

Note that, if, unlike the present configuration, the rotational speed of the first wheel and the second wheel in the curved section is not changed relative to the rotational speed of the first wheel and the second wheel in the straight section, the moving speed of the center portion of the transport vehicle in the curved section in which the target rail is located on the inner-circumferential side becomes higher than the moving speed of the center portion of the transport vehicle in the straight section. For this reason, it may be necessary to reduce the moving speed of the center portion of the transport vehicle in the straight section in order to reduce the moving speed of the center portion of the transport vehicle in the curved section to the maximum allowable speed or less. In contrast, according to the present configuration, the moving speed of the center portion of the transport vehicle in the curved section can be brought close to the moving speed of the center portion of the transport vehicle in the straight section. Therefore, it is less necessary to reduce the moving speed of the center portion of the transport vehicle in the straight section, and the time required for the transport vehicle to travel along the travel path that includes both the straight section and the curved section can also be shortened.

Here, it is preferable that the control unit sets the rotational speed of the first wheel and the second wheel in the curved section in a case of traveling at a set speed, to a speed obtained by multiplying the rotational speed of the first wheel and the second wheel in a case of traveling in the straight section at the set speed by a value obtained by dividing the second length by the first length.

According to the present configuration, the moving speed of the center portion of the transport vehicle in the curved section can be made the same as or similar to the moving speed of the center portion of the transport vehicle in the straight section. Accordingly, the speed change at the center portion of the transport vehicle when passing through the boundary between the straight section and the curved section can be easily reduced.

It is preferable that the control unit starts changing the rotational speed of the first wheel and the second wheel in accordance with a timing at which the travel unit enters the curved section from the straight section and a timing at which the travel unit enters the straight section from the curved section.

According to the present configuration, the rotational speed of the first wheel and the second wheel can start being changed in accordance with the timing at which the difference between the moving speed of the center portion of the transport vehicle and the moving speed of the target wheel starts changing. Accordingly, the rotational speed of the first wheel and the second wheel can be changed in accordance with the change in the difference between the moving speed of the center portion of the transport vehicle and the moving speed of the target wheel, and the speed change at the center portion of the transport vehicle when passing through the boundary between the straight section and the curved section can be smoothed.

It is preferable that when changing the rotational speed of the first wheel and the second wheel between the rotational speed in the straight section and the rotational speed in the curved section, the control unit changes the rotational speed of the first wheel and the second wheel such that a first-order differential value of the rotational speed is constant.

According to the present configuration, since the change rate of the rotational speed of the first wheel and the second wheel when the rotational speed of the first wheel and the second wheel is changed is constant, it is possible to simplify the control to change the rotational speed of the first wheel and the second wheel between the rotational speed in the straight section and the rotational speed in the curved section.

It is preferable that when changing the rotational speed of the first wheel and the second wheel between the rotational speed in the straight section and the rotational speed in the curved section, the control unit changes the rotational speed of the first wheel and the second wheel such that a second-order differential value of the rotational speed is constant.

According to the present configuration, it is easier to change the rotational speed of the first wheel and reader the second wheel so as to smooth the change in the moving acceleration of the center portion of the transport vehicle than in the case of changing the rotational speed of the first wheel and the second wheel so as to make a first-order differential value of the rotational speed constant, when changing the rotational speed of the first wheel and the second wheel. Accordingly, vibration that may occur on the transport vehicle and the article transported by the transport vehicle can be easily reduced.

It is preferable that a detected body is provided at a position corresponding to a boundary between the straight section and the curved section in the travel path, and an information holder is provided at a position on an upstream side of the travel path with respect to the boundary, the information holder holding address information indicating the position, the transport vehicle includes a detection device configured to detect the detected body, a reading device configured to read the address information held by the information holder, and a measuring device configured to measure a travel distance of the travel unit, assuming that a region extending along the travel path on both sides of the boundary is a boundary region, the control unit derives an estimated current position that is a current estimated position of the travel unit, based on the address information read by the reading device and the travel distance measured by the measuring device, and determines that the travel unit has reached the boundary and starts changing the rotational speed of the first wheel and the second wheel if a first condition or a second condition is satisfied, the first condition is that the estimated current position is a position within the boundary region, and that the detected body has been detected by the detection device, and the second condition is that, after the estimated current position entered the boundary region, the estimated current position has reached an end portion of the boundary region on a downstream side of the travel path without the detected body being detected by the detection device.

According to the present configuration, the rotational speed of the first wheel and the second wheel can appropriately start being changed based on the first condition and the second condition. Specifically, the first condition, which is a condition for starting changing the rotational speed of the first wheel and the second wheel, includes that the estimated current position is a position within the boundary region, in addition to that the detected body has been detected by the detection device. Therefore, it is possible to determine that the detection of the detected body by the detection device in a state where the estimated current position is a position within the boundary region is a correct detection and to start changing the rotational speed of the first wheel and the second wheel, while determining that the detection of the detected body by the detection device in a state where the estimated current position is not a position within the boundary region is an incorrect detection and not starting changing the rotational speed of the first wheel and the second wheel. Further, even if the first condition is not satisfied, the rotational speed of the first wheel and the second wheel can start being changed if the second condition is satisfied. Therefore, the rotational speed of the first wheel and the second wheel can start being changed even when the detected body cannot be detected by the detection device due to detachment of the detected body or dirt thereon, etc., although the travel unit has reached the boundary between the straight section and the curved section.

It is preferable that, assuming that the travel unit is a first travel unit, the transport vehicle includes a second travel unit arranged on a front side in a front-back direction along the travel path with respect to the first travel unit, and a main body portion connected to the first travel unit and the second travel unit, the first travel unit is connected to the main body portion so as to be capable of rotating about a first axis parallel to the vertical direction, the second travel unit is connected to the main body portion so as to be capable of rotating about a second axis parallel to the vertical direction, assuming that the guide wheel is a first guide wheel, the second travel unit includes a third wheel configured to roll on the traveling surface of the first travel rail, a fourth wheel configured to roll on the traveling surface of the second travel rail, and a second guide wheel configured to roll on the guide surface of the guide rail, the control unit controls the rotational speed of the first wheel and the second wheel so as to adjust the rotational speed to a target rotational speed, and causes the second travel unit to travel following the traveling of the first travel unit, assuming that the target wheel is a first target wheel and the non-target wheel is a first non-target wheel, a second target wheel is the third wheel when the first wheel is the first target wheel, the second target wheel is the fourth wheel when the second wheel is the first target wheel, and a second non-target wheel is whichever one of the third wheel and the fourth wheel is not the second target wheel, the second travel unit travels in the curved section in an orientation in which the second target wheel comes into contact with the target rail, the second guide wheel comes into contact with the guide rail, and the second non-target wheel does not come into contact with the non-target rail, and the control unit determines that the first travel unit has reached the boundary between the straight section and the curved section in the travel path and starts changing the rotational speed of the first wheel and the second wheel, at a point when the first travel unit has traveled a distance corresponding to a gap in the front-back direction between the first target wheel and the second target wheel since the control unit detected a change in a rotational speed of the second target wheel relative to the rotational speed of the first target wheel.

When the control unit controls the rotational speed of the first wheel and the second wheel so as to adjust the rotational speed to the target rotational speed and causes the second travel unit to travel following the traveling of the first travel unit, as in the present configuration, the rotational speed of the second target wheel changes from the target rotational speed (i.e., the rotational speed of the first target wheel) with the rotational speed of the first target wheel maintained at the target rotational speed, before and after the second travel unit passes through the boundary between the straight section and the curved section. According to the present configuration, it is possible to determine whether or not the first travel unit has reached the boundary between the straight section and the curved section and start changing the rotational speed of the first wheel and the second wheel, based on the result of detecting such a change in the rotational speed of the second target wheel relative to the rotational speed of the first target wheel.

The article transport facility according to the present disclosure need only exhibit at least one of the above-described effects.

What is claimed is:

1. An article transport facility comprising:

travel rails arranged along a travel path;

a transport vehicle configured to travel along the travel rails and transport an article; and a control unit configured to control a traveling operation of a travel unit included in the transport vehicle, wherein:

the travel path includes a straight section that is formed in a straight shape in a plan view, and a curved section that is formed in a curved shape in a plan view, in the straight section, a first travel rail and a second travel rail among the travel rails are arranged separately on respective sides of a center portion in a widthwise direction of the travel path and, in the curved section, with one out of the first travel rail and the second travel rail being a target rail and the other one being a non-target rail, at least the target rail, out of the target rail and the non-target rail, is arranged along the travel path, and a guide rail that is different from the target rail and the non-target rail is also arranged along the travel path, the travel unit includes a first wheel configured to roll on a traveling surface of the first travel rail, a second wheel configured to roll on a traveling surface of the second travel rail, a drive unit configured to rotate the first wheel and the second wheel at the same speed, and a guide wheel configured to roll on a guide surface of the guide rail, when a target wheel is the first wheel when the target rail is the first travel rail, and when the target wheel is the second wheel when the target rail is the second travel rail, and a non-target wheel is whichever one of the first wheel and the second wheel is not the target wheel, the travel unit travels in the curved section in an orientation in which the target wheel comes into contact with the target rail, the guide wheel comes into contact with the guide rail, and the non-target wheel does not come into contact with the non-target rail, and the control unit changes a rotational speed of the first wheel and the second wheel in the curved section relative to a rotational speed of the first wheel and the second wheel in the straight section in accordance with a ratio of a second length, which is a length of the target rail along the travel path, to a first length, which is a length of the curved section along the travel path at the center portion in the widthwise direction of the travel path.

2. The article transport vehicle according to claim 1, wherein the control unit sets the rotational speed of the first wheel and the second wheel in the curved section in a case of traveling at a set speed, to a speed obtained by multiplying the rotational speed of the first wheel and the second wheel in a case of traveling in the straight section at the set speed by a value obtained by dividing the second length by the first length.

3. The article transport vehicle according to claim 1, wherein the control unit starts changing the rotational speed of the first wheel and the second wheel in accordance with a timing at which the travel unit enters the curved section from the straight section and a timing at which the travel unit enters the straight section from the curved section.

4. The article transport vehicle according to claim 1, wherein when changing the rotational speed of the first wheel and the second wheel between the rotational speed in the straight section and the rotational speed in the curved section, the control unit changes the rotational speed of the first wheel and the second wheel such that a first-order differential value of the rotational speed is constant.

5. The article transport vehicle according to claim 1, wherein when changing the rotational speed of the first wheel and the second wheel between the rotational speed in the straight section and the rotational speed in the curved section, the control unit changes the rotational speed of the first wheel and the second wheel such that a second-order differential value of the rotational speed is constant.

6. The article transport vehicle according to claim 1, wherein:

a detected body is provided at a position corresponding to a boundary between the straight section and the curved section in the travel path, and an information holder is provided at a position on an upstream side of the travel path with respect to the boundary, the information holder holding address information indicating the position, the transport vehicle includes a detection device configured to detect the detected body, a reading device configured to read the address information held by the information holder, and a measuring device configured to measure a travel distance of the travel unit, a region extending along the travel path on both sides of the boundary is a boundary region, the control unit derives an estimated current position that is a current estimated position of the travel unit based on the address information read by the reading device and the travel distance measured by the measuring device, and determines that the travel unit has reached the boundary and starts changing the rotational speed of the first wheel and the second wheel if a first condition or a second condition is satisfied, the first condition is that the estimated current position is a position within the boundary region, and that the detected body has been detected by the detection device, and the second condition is that, after the estimated current position entered the boundary region, the estimated current position has reached an end portion of the boundary region on a downstream side of the travel path without the detected body being detected by the detection device.

7. The article transport vehicle according to claim 1, wherein:

when the travel unit is a first travel unit, the transport vehicle includes a second travel unit arranged on a front side in a front-back direction along the travel path with respect to the first travel unit, and a main body portion connected to the first travel unit and the second travel unit, the first travel unit is connected to the main body portion so as to be rotatable about a first axis parallel to the vertical direction, the second travel unit is connected to the main body portion so as to be rotatable about a second axis parallel to the vertical direction, assuming that the guide wheel is a first guide wheel, the second travel unit includes a third wheel configured to roll on the traveling surface of the first travel rail, a fourth wheel configured to roll on the traveling surface of the second travel rail, and a second guide wheel configured to roll on the guide surface of the guide rail, the control unit controls the rotational speed of the first wheel and the second wheel so as to adjust the rotational speed to a target rotational speed, and causes the second travel unit to travel following the traveling of the first travel unit, when the target wheel is a first target wheel and the non-target wheel is a first non-target wheel, a second target wheel is the third wheel when the first wheel is the first target wheel, the second target wheel is the fourth wheel when the second wheel is the first target wheel, and a second non-target wheel is whichever one of the third wheel and the fourth wheel is not the second target wheel, the second travel unit travels in the curved section in an orientation in which the second target wheel comes into contact with the target rail, the second guide wheel comes into contact with the guide rail, and the second non-target wheel does not come into contact with the non-target rail, and the control unit determines that the first travel unit has reached the boundary between the straight section and the curved section in the travel path and starts changing the rotational speed of the first wheel and the second wheel, at a point when the first travel unit has traveled a distance corresponding to a gap in the front-back direction between the first target wheel and the second target wheel since the control unit detected a change in a rotational speed of the second target wheel relative to the rotational speed of the first target wheel.

* * * * *